US008962335B2

(12) United States Patent
Kitamura et al.

(10) Patent No.: US 8,962,335 B2
(45) Date of Patent: Feb. 24, 2015

(54) GAMING MACHINE AND CONTROL METHOD THEREOF

(75) Inventors: Kenta Kitamura, Koto-ku (JP); Hiroki Munakata, Koto-ku (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 605 days.

(21) Appl. No.: 12/782,260

(22) Filed: May 18, 2010

(65) Prior Publication Data

US 2010/0304816 A1 Dec. 2, 2010

(30) Foreign Application Priority Data

May 28, 2009 (JP) ..... 2009-129322

(51) Int. Cl.
*A63F 9/00* (2006.01)
*G07F 17/32* (2006.01)

(52) U.S. Cl.
CPC ..... *G07F 17/322* (2013.01); *G07F 17/32* (2013.01); *G07F 17/3293* (2013.01)
USPC ..... 436/11; 463/37

(58) Field of Classification Search
USPC ..... 463/11, 37
See application file for complete search history.

(56) References Cited

U.S. PATENT DOCUMENTS 6,543,770 B1 4/2003 Kaji et al.
7,081,882 B2 * 7/2006 Sowden et al. ..... 345/156
2002/0113369 A1 * 8/2002 Weingardt ..... 273/269
2002/0119813 A1 * 8/2002 Colin et al. ..... 463/11
2005/0090304 A1 * 4/2005 Crawford et al. ..... 463/13
2007/0149283 A1 * 6/2007 Poh et al. ..... 463/37
2008/0026826 A1 * 1/2008 Groswirt ..... 463/25
2008/0119257 A1 * 5/2008 Stern et al. ..... 463/13
2008/0194334 A1 * 8/2008 Kuok et al. ..... 463/42
2009/0115133 A1 * 5/2009 Kelly et al. ..... 273/274
2009/0124379 A1 * 5/2009 Wells ..... 463/31
2009/0143141 A1 * 6/2009 Wells et al. ..... 463/37
2009/0253503 A1 * 10/2009 Krise et al. ..... 463/31
2010/0062839 A1 3/2010 Kitamura
2010/0117299 A1 * 5/2010 Nicely et al. ..... 273/287

(Continued)

FOREIGN PATENT DOCUMENTS

JP 2008272089 A 11/2008

OTHER PUBLICATIONS

"Baccarat rule" (http://web.archive.org/web/20090129144208/http://ildado.com/baccarat_rules.html) Jan. 29, 2009.*
U.S. Appl. No. 12/779,342, filed May 13, 2010, Okada.

(Continued)

*Primary Examiner* — Xuan Thai
*Assistant Examiner* — Michael Grant
(74) *Attorney, Agent, or Firm* — KMF Patent Services, PLLC; S. Peter Konzel; Kenneth M. Fagin

(57) ABSTRACT

The present invention provides a gaming machine executing the processing of (A) displaying on the display at least one playing card in a display mode that displays each playing card face down; and (B) changing the display mode of one of the at least one playing card displayed in the processing (A) to a display mode enabling a part of the front of the playing card to be viewable, upon contact on any position within an area of the touch panel corresponding to an area of the display where the one of the at least one playing card is displayed.

6 Claims, 21 Drawing Sheets

| Contact time interval T | 0<T≦0.5 | 0.5<T≦2 | 2<T |
|---|---|---|---|
| Display speed V of squeeze image | Fast | Normal | Slow |

(56) References Cited

U.S. PATENT DOCUMENTS

2010/0130280 A1* 5/2010 Arezina et al. ..... 463/20
2010/0190550 A1 7/2010 Kitamura

OTHER PUBLICATIONS

U.S. Appl. No. 12/782,095, filed May 18, 2010, Inamura, et al.
U.S. Appl. No. 12/782,191, filed May 18, 2010, Munakata.

* cited by examiner

FIG. 2

| Coordinate table | | |
|---|---|---|
| | Player card I | Player card II |
| Player card display area | $10 \leqq X \leqq 30$ | $40 \leqq X \leqq 60$ |
| | $20 \leqq Y \leqq 60$ | $20 \leqq Y \leqq 60$ |
| Contact effective area | $10 \leqq x \leqq 30$ | $40 \leqq x \leqq 60$ |
| | $20 \leqq y \leqq 60$ | $20 \leqq y \leqq 60$ |

FIG. 12A

| Relationship between number on card and point | |
|---|---|
| Number on card | Point |
| A | 1 |
| 2 | 2 |
| 3 | 3 |
| 4 | 4 |
| 5 | 5 |
| 6 | 6 |
| 7 | 7 |
| 8 | 8 |
| 9 | 9 |
| 10、J、Q、K | 0 |

FIG. 12B

| Display rules for third player card | |
|---|---|
| | Ones digit of total point of two cards |
| Display | 0,1,2,3,4,5 |
| Do not display | 6,7,8,9 |

FIG. 12C

| Display rules for third banker card (when third player card is not displayed) | |
|---|---|
| | Ones digit of total point of two cards |
| Display | 0,1,2,3,4,5 |
| Do not display | 6,7,8,9 |

FIG. 12D

| Display rules for third banker card (when third player card is displayed) | | |
|---|---|---|
| Ones digit of total point of two cards | Third player card | |
| 0,1,2 | —<br>— | Always display |
| 3 | 0,1,2,3,4,5,6,7,9<br>8 | Display<br>Do not display |
| 4 | 2,3,4,5,6,7<br>0,1,8,9 | Display<br>Do not display |
| 5 | 4,5,6,7<br>0,1,2,3,8,9 | Display<br>Do not display |
| 6 | 6,7<br>0,1,2,3,4,5,8,9 | Display<br>Do not display |
| 7,8,9 | —<br>— | Always do not display |

FIG. 14

| Contact time interval T | 0<T≦0. 5 | 0. 5<T≦2 | 2<T |
|---|---|---|---|
| Display speed V of squeeze image | Fast | Normal | Slow |

(Player terminal)

GAMING MACHINE AND CONTROL METHOD THEREOF

CROSS-REFERENCE TO RELATED APPLICATIONS

This application is based upon and claims a priority from the prior Japanese Patent Application No. 2009-129322 filed on May 28, 2009, the entire contents of which are incorporated herein by reference.

BACKGROUND OF THE INVENTION

1. Field of the Invention

The present invention relates to a gaming machine and a control method thereof.

2. Discussion of the Background

Up until now, card games such as poker, blackjack, and baccarat are known as a game which uses playing cards (hereinafter also referred to simply as a card). In such a card game, the result of a game is determined based on the markings (e.g., numbers and suits) drawn on the cards.

In such a card game, cards are often distributed face down so that players cannot see the markings on the cards. Turning over those cards distributed face down, the players can see the markings drawn on the fronts of the cards. The markings on the fronts of the cards determine the result of the game concerned, i.e., greatly affect whether or not a player can obtain game media such as coins. For this reason, players usually expect that the fronts of the cards have their desired markings. Such expectation is a major factor that makes the player playing a card game more excited and makes the card game more attractive to the player.

On the other hand, gaming machines capable of executing such a card game have been installed in recreation facilities such as a casino in recent years. Also, gaming machines are proposed which are capable of receiving via an input device a command input for turning over a card (for example, see Patent Documents 1 to 3). Such a gaming machine is considered to allow a player to enjoy the sense of turning over a card when he or she plays a card game on the gaming machine.

Patent Document 1: US 2008/0194334-A1

Patent Document 2: US 2005/0090304-A1

Patent Document 3: US 2007/0149283-A1

When inputting a command to turn over a card to a gaming machine described above, the player needs to touch the predetermined area on a touch panel. Such an area is comparatively limited, and thus may possibly bring the player difficulties in making operations. That is, the player needs to touch the limited area in inputting a command to turn over a card. Touching other areas will not turn over a card, and therefore the player must be careful to some extent. In such a situation, the player may find it troublesome to make the operation of turning over a card which should be exciting under ordinary circumstances. Accordingly, with those gaming machines, the players may not be able to fully enjoy a card game.

The present invention was made in view of the above mentioned problems, and an object thereof is to provide a gaming machine that enables easy operation of turning over a card to let a player further enjoy a card game; and a control method thereof.

SUMMARY OF THE INVENTION

The present invention provides a gaming machine having the following configuration.

(1) That is, the gaming machine comprises:

a display capable of displaying a playing card that has a predetermined marking drawn on the front and does not have the predetermined marking drawn on the back;

a touch panel provided on the front of the display; and a controller.

The controller is programmed to execute the processing of:

(A) displaying on the display at least one playing card in a display mode that displays each playing card face down; and (B) changing the display mode of one of the at least one playing card displayed in the processing (A) to a display mode enabling apart of the front of the playing card to be viewable, upon contact on any position within an area of the touch panel corresponding to an area of the display where the one of the at least one playing card is displayed.

According to the invention of (1), upon contact on any position within an area of the touch panel corresponding to an area of the display (hereinafter referred to also as a card display area) which displays any one of the playing cards displayed in a display mode that displays each card face down (hereinafter such a card is referred to also as a face-down card), the display mode of the one playing card changes to the display mode enabling a part of the front of the playing card to be viewable. That is, the scene is displayed in which the face-down card is turned over. Such a scene is displayed upon contact on any position as long as the position is within an area of the touch panel (hereinafter referred to also as a contact effective area) corresponding to the card display area.

Players therefore can input a command to turn over a card upon touching any position corresponding to the card display area. This avoids a situation in which the player needs to very carefully perform an operation for turning over a card, making it possible to decrease the possibility that the player finds it troublesome to perform the operation for turning over a card. As a result, it is possible to let a player further enjoy a card game.

Note that, in the invention of (1), a predetermined marking relates to determination of a result of a game. A result of a game is to be determined based on the marking drawn on the front of the playing card displayed on the display. A contact effective area is an area of the touch panel which has the substantially same dimension as that of the card display area.

The present invention also provides a gaming machine having the following configuration.

(2) That is, the gaming machine comprises:

a display capable of displaying a playing card in a predetermined card display area, the playing card having a predetermined marking drawn on the front and not having the predetermined marking drawn on the back;

a touch panel which is provided on the front of the display and which, upon contact thereon, transmits a contact detection signal carrying coordinate information corresponding to the position of the contact;

a memory storing address information on one or more card display areas, for each card display area; and a controller.

The controller is programmed to execute the processing of:

(A) displaying at least one playing card in a card display area of the display in a display mode displaying each playing card face down, based on the address information stored in the memory;

(B) determining, upon reception of a contact detection signal from the touch panel, whether or not a position on the touch panel, corresponding to coordinate information carried by the received contact detection signal, is within an area of the touch panel corresponding to any one of the one or more card display areas shown by the address information stored in the memory; and (C) changing the display mode of a playing card, displayed in one card display area corresponding to an area of the touch panel which includes the position on the touch panel corresponding to the coordinate information carried by the received contact detection signal, to a display mode enabling a part of the front of the playing card to be viewable, when the controller determines in the processing (B) that the position on the touch panel is within an area of the touch panel corresponding to any one of the one or more card display areas shown by the address information stored in the memory.

According to the invention of (2), a determination is made whether or not the position on the touch panel corresponding to the coordinate information carried by the contact detection signal received from the touch panel is within an area of the touch panel corresponding to any one of the one or more card display areas. When a determination is made that the position on the touch panel corresponding to the coordinate information carried by the received contact detection signal is within the area of the touch panel corresponding to any one of the card display areas, the display mode of the playing card displayed in the one card display area corresponding to the area of the touch panel, including the above position on the touch panel, changes to a display mode enabling a part of the front of the playing card to be viewable. That is, the scene is displayed in which the face-down card is turned over. Such a scene is displayed upon contact on any position as long as the position is within an area of the touch panel (hereinafter referred to also as a contact effective area) corresponding to the card display area.

Players therefore can input a command to turn over a card upon touching any position corresponding to the card display area. This avoids a situation in which the player needs to very carefully perform an operation for turning over a card, making it possible to decrease the possibility that the player finds it troublesome to perform the operation for turning over a card. As a result, it is possible to let a player further enjoy a card game.

Note that, in the invention of (2), a predetermined marking relates to determination of a result of a game. A result of a game is to be determined based on the marking drawn on the front of the playing card displayed on the display. A contact effective area is an area of the touch panel which has the substantially same dimension as that of the card display area.

Further, the present invention desirably has the following configuration.

(3) That is, the display includes a plurality of the card display areas, the memory stores pieces of address information each showing a card display area, for the respective card display areas, the processing (A) includes displaying multiple playing cards to the respective card display areas in a display mode that displays each playing card face down, based on the pieces of the address information stored in the memory, the processing (B) includes determining, upon reception of a contact detection signal from the touch panel, whether or not a position on the touch panel, corresponding to coordinate information carried by the received contact detection signal, is within an area of the touch panel corresponding to anyone of the multiple card display areas shown by the pieces of the address information stored in the memory, and the processing (C) includes changing the display mode of a playing card, displayed in one card display area corresponding to an area of the touch panel which includes the position on the touch panel corresponding to the coordinate information carried by the received contact detection signal, to a display mode enabling a part of the front of the playing card to be viewable, when the controller determines in the processing (B) that the position on the touch panel is within an area of the touch panel corresponding to any one of the multiple card display areas shown by the pieces of the address information stored in the memory.

According to the invention of (3), a player can input a command to turn over any playing card among multiple playing cards by touching any desired position within the area of the touch panel corresponding to the card display area in which the desired playing card is displayed. This further improves the convenience of the operation for turning over a card, thereby letting a player further enjoy a card game.

The present invention also provides a control method of a gaming machine having the following configuration.

(4) That is, the gaming machine comprises:

a display capable of displaying a playing card that has a predetermined marking drawn on the front and does not have the predetermined marking drawn on the back;

a touch panel provided on the front of the display; and a controller.

Also, the control method comprises the steps of:

(A) the controller displaying on the display at least one playing card in a display mode that displays each playing card face down; and (B) the controller changing the display mode of one of the at least one playing card displayed in the step (A) to a display mode enabling a part of the front of the playing card to be viewable, upon contact on any position within an area of the touch panel corresponding to an area of the display where the one of the at least one playing card is displayed.

According to the invention of (4), upon contact on any position within an area of the touch panel corresponding to an area of the display (hereinafter referred to also as a card display area) which displays any one of the playing cards displayed in a display mode that displays each card face down (hereinafter such a card is referred to also as a face-down card), the display mode of the one playing card changes to the display mode enabling a part of the front of the playing card to be viewable. That is, the scene is displayed in which the face-down card is turned over. Such a scene is displayed upon contact on any position as long as the position is within an area of the touch panel (hereinafter referred to also as a contact effective area) corresponding to the card display area.

Players therefore can input a command to turn over a card upon touching any position corresponding to the card display area. This avoids a situation in which the player needs to very carefully perform an operation for turning over a card, making it possible to decrease the possibility that the player finds it troublesome to perform the operation for turning over a card. As a result, it is possible to let a player further enjoy a card game.

Note that, in the invention of (4), a predetermined marking relates to determination of a result of a game. A result of a game is to be determined based on the marking drawn on the front of the playing card displayed on the display. A contact effective area is an area of the touch panel which has the substantially same dimension as that of the card display area.

The present invention enables easy operation of turning over a card to let a player further enjoy a card game; and a control method thereof.

BRIEF DESCRIPTION OF THE DRAWINGS

FIG. 2 is a view illustrating a coordinate table showing corresponding relationships between a player card display area and a contact effective area;

FIG. 12A is a view illustrating baccarat rules;

FIG. 12B is another view illustrating the baccarat rules;

FIG. 12C is another view illustrating the baccarat rules;

FIG. 12D is yet another view illustrating the baccarat rules;

FIG. 14 is a view illustrating relationships between contact time intervals and display speeds of a squeeze image;

DESCRIPTION OF THE EMBODIMENTS

Hereinafter, embodiments (first embodiment and second embodiment) of the present invention will be described.

A gaming machine 1 according to the embodiments of the present invention executes baccarat.

First, baccarat will be described.

In baccarat, six decks or eight decks of playing cards (52 cards in one deck) are used. The front of each card has one number and one suit drawn thereon. The number drawn on each card is one of "2", "3", "4", "5", "6", "7", "8", "9", "10", "J", "Q", "K", and "A". The suit drawn on each card is one of "Spades", "Hearts", "Diamonds", and "Clubs". The numbers and suits each correspond to the predetermined marking of the present invention.

The back of each card does not have any numbers or suits drawn thereon but has some pattern drawn thereon.

Note that, in the present description, symbols "J", "Q", "K", and "A" are also called numbers.

In baccarat, a game result is determined based on the point calculated from the player cards and the point calculated from the banker cards. The determination method of a game result in baccarat will be described later in detail with reference to FIG. 12 and FIG. 13.

A player predicts which of the point calculated from the player cards and the point calculated from the banker cards will be larger so as to place a bet on one of "PLAYER", "BANKER", and "TIE".

After a game starts, two player cards and two banker cards are displayed on a display in a display mode in which the number and suit drawn on the cards cannot be seen (that is, cards are displayed face down). Then, the player with the largest amount of a bet, among the players betting on "PLAYER", can operate a touch panel to input a command to turn over a face-down card (a squeeze command).

Hereinafter, the squeeze command according to the first embodiment and the second embodiment will be described with reference to drawings.

[First Embodiment]

Figure 1A:
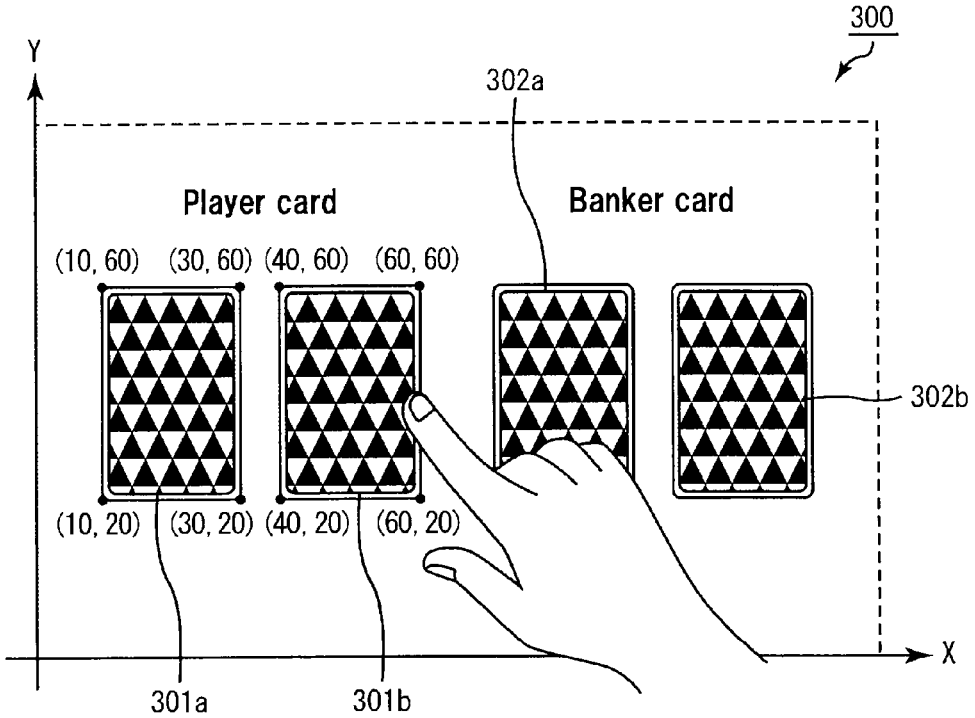
FIG. 1A is a view illustrating a scene in which a card is displayed in a game result determination card display area of a liquid crystal display.

First, the first embodiment will be summarized based on FIG. 1 (FIG. 1A to FIG. 10) and FIG. 2.

Figure 1B:
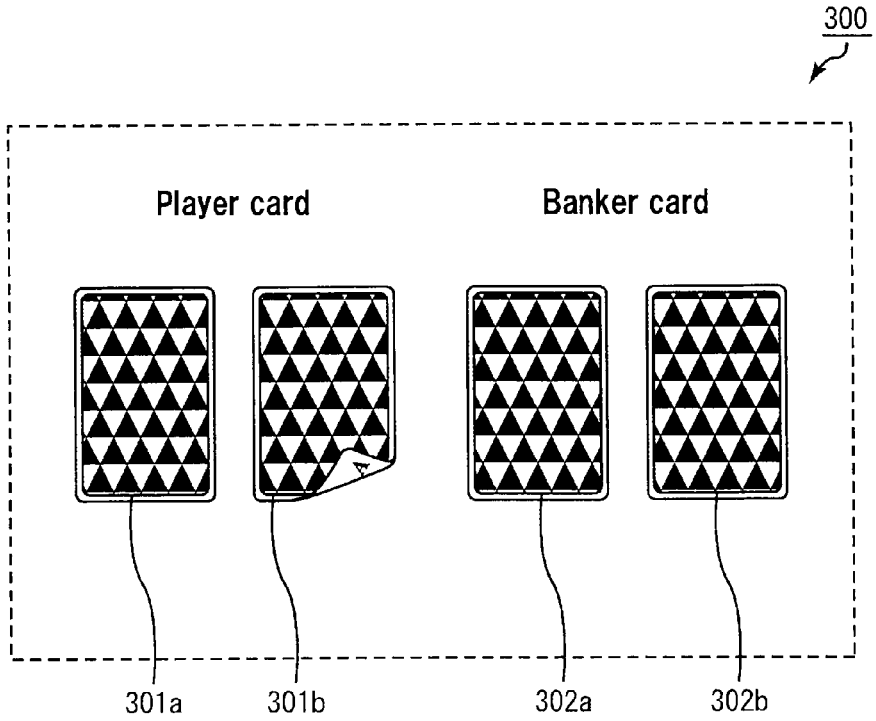
FIG. 1B is another view illustrating a scene in which a card is displayed in the game result determination card display area of the liquid crystal display.

FIG. 1A and FIG. 1B are views illustrating a scene in which a card is displayed in a game result determination card display area of a liquid crystal display.

Figure 1C:
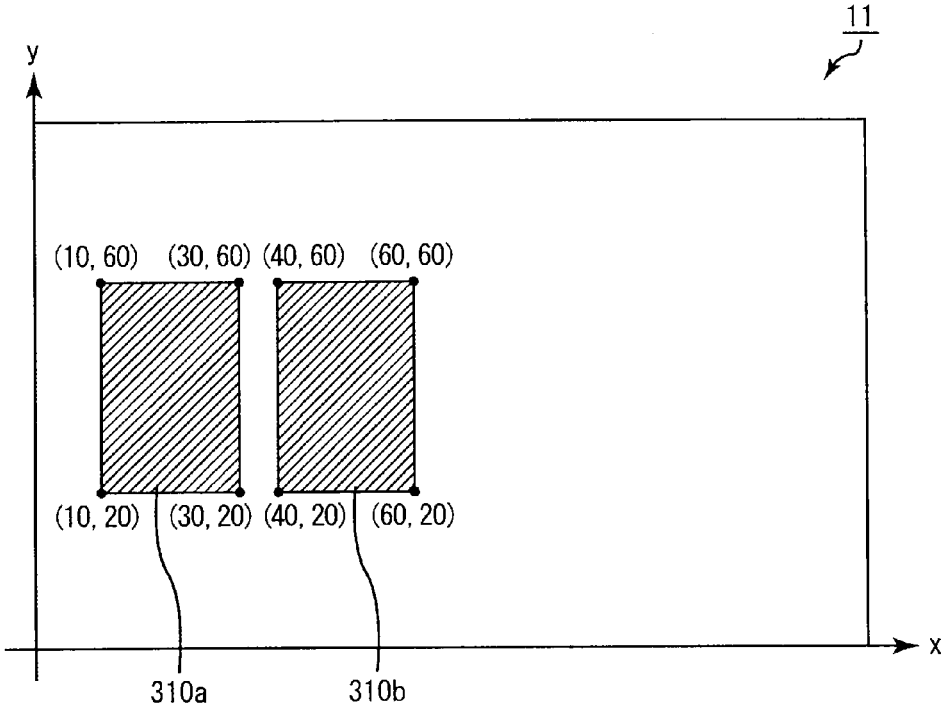
FIG. 1C is a view for explaining a contact effective area of a touch panel.

FIG. 1C is a view for explaining a contact effective area of a touch panel.

FIG. 2 is a view illustrating a coordinate table showing corresponding relationships between a player card display area and a contact effective area.

In FIG. 1A, two player cards 301 (player card I301*a*, player card II301*b*) and two banker cards 302 (banker cards 302*a*, 302*b*) are displayed face down in a game result determination card display area 300. The game result determination card display area 300 is an area provided to a liquid crystal display 10 (see FIG. 7). The liquid crystal display 10 corresponds to the display of the present invention.

Here, the player card I301*a* is displayed in a player card I display area. The player card II301*b* is displayed in a player card II display area. As illustrated in FIG. 1A, the player card I display area and the player card II display area are predetermined areas within the game result determination card display area 300, and are represented by respective X coordinate ranges and Y coordinate ranges (see FIG. 2). The player card I display area is an area represented by $10 \leq X \leq 30$ and $20 \leq Y \leq 60$. The player card II display area is an area represented by $40 \leq X \leq 60$ and $20 \leq Y \leq 60$ (see FIG. 2).

The gaming machine 1 according to the first embodiment has a touch panel 11 on the front of the liquid crystal display 10. By touching the contact effective area on the touch panel 11, a player can input a squeeze command. The contact effective area consists of a contact effective area I and a contact effective area II. The contact effective area I is an area of the touch panel 11. The contact effective area I corresponds to the player card I display area and has the substantially same dimension as that of the player card I display area. The contact effective area II is an area of the touch panel 11. The contact effective area II corresponds to the player card II display area and has the substantially same dimension as that of the player card II display area.

Figure 10:
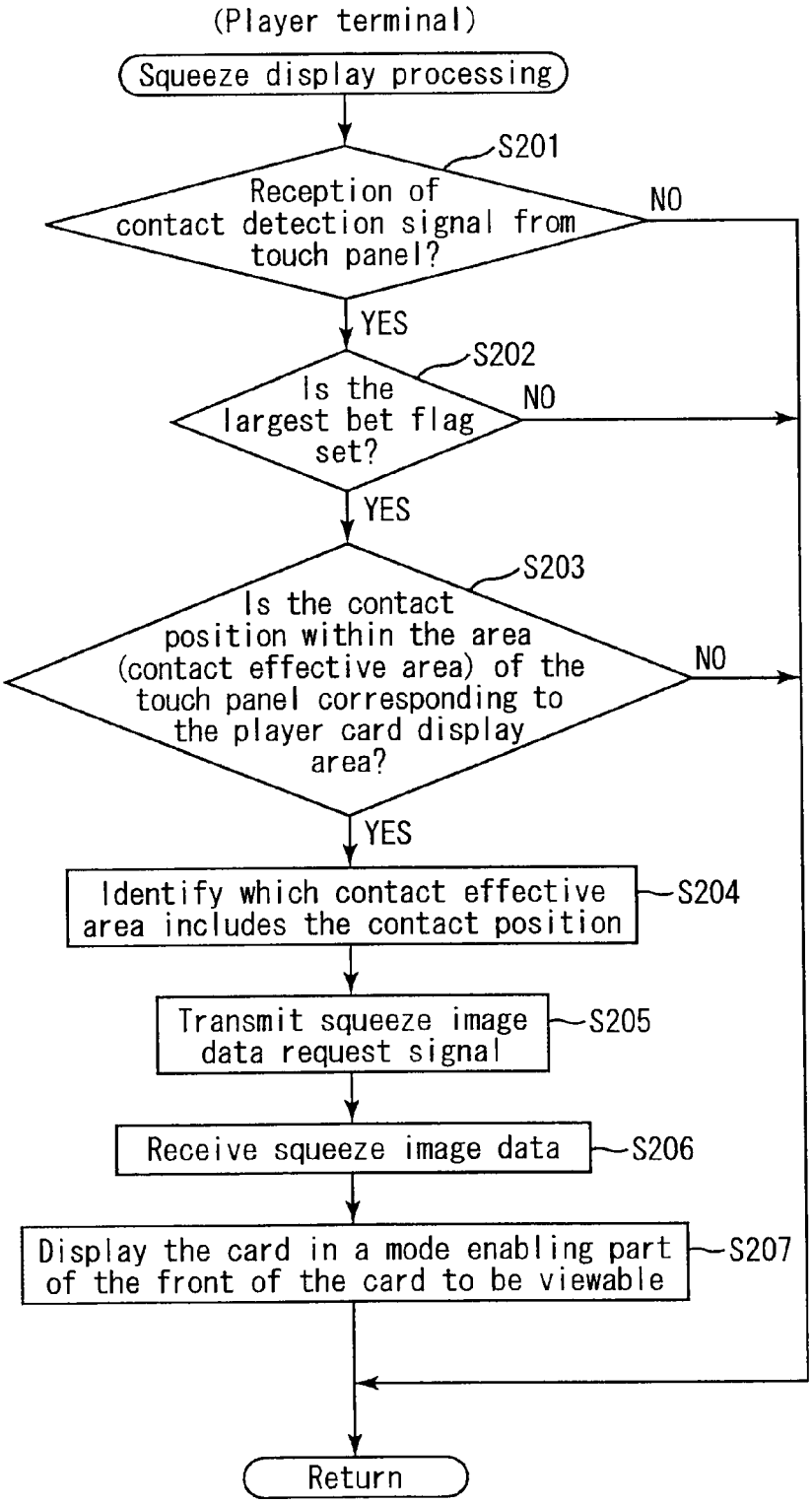
FIG. 10 is a flowchart illustrating a subroutine of squeeze-display processing executed in each player terminal according to a first embodiment.

As shown in FIG. 10 and FIG. 2, the contact effective area is represented by x coordinate ranges and y coordinate ranges. The contact effective area I310*a* is an area represented by $10 \leq X \leq 30$ and $20 \leq y \leq 60$. The contact effective area II310*b* is an area represented by $40 \leq x \leq 60$ and $20 \leq y \leq 60$.

When a player touches the contact effective area I310*a*, a scene is displayed in which the player card I301*a* displayed in the player card I display area is turned over. When a player touches the contact effective area II310*b*, a scene is displayed in which the player card II301*b* displayed in the player card II display area is turned over.

FIG. 1A and FIG. 1B each show a scene in which the player card II301*b* displayed in the player card II display area is turned over when the contact effective area II310*b* has been touched by a player.

Hereinbefore, the first embodiment has been summarized with reference to FIG. 1 and FIG. 2.

In the present description, changing the display mode from the face-down display mode to the display mode enabling a part of the front to be viewable is also referred to as "turning over a card".

Note that the X-axis, the Y-axis, the XY coordinates, and the image of a finger illustrated in FIG. 1A will not be actually displayed on the liquid crystal display 10. Also, the x-axis, the y-axis, the xy coordinates, and the contact effective areas illustrated in FIG. 1C are not actually drawn on the touch panel 11. These are illustrated for convenience of explanation.

Hereinafter, the first embodiment will be further described in detail.

In the following, an outline of the gaming machine 1 according to the present embodiment will be described in detail with reference to the accompanying drawings. The gaming machine 1 according to the present embodiment is a kind of multiplayer participation gaming machine. Accordingly, the gaming machine 1 is provided with a plurality of player terminals 4 (see FIG. 3). In the gaming machine 1, baccarat, one of card games, is executed.

First, a general structure of the gaming machine 1 according to the present embodiment will be described in detail with reference to accompanying drawings.

Figure 3:
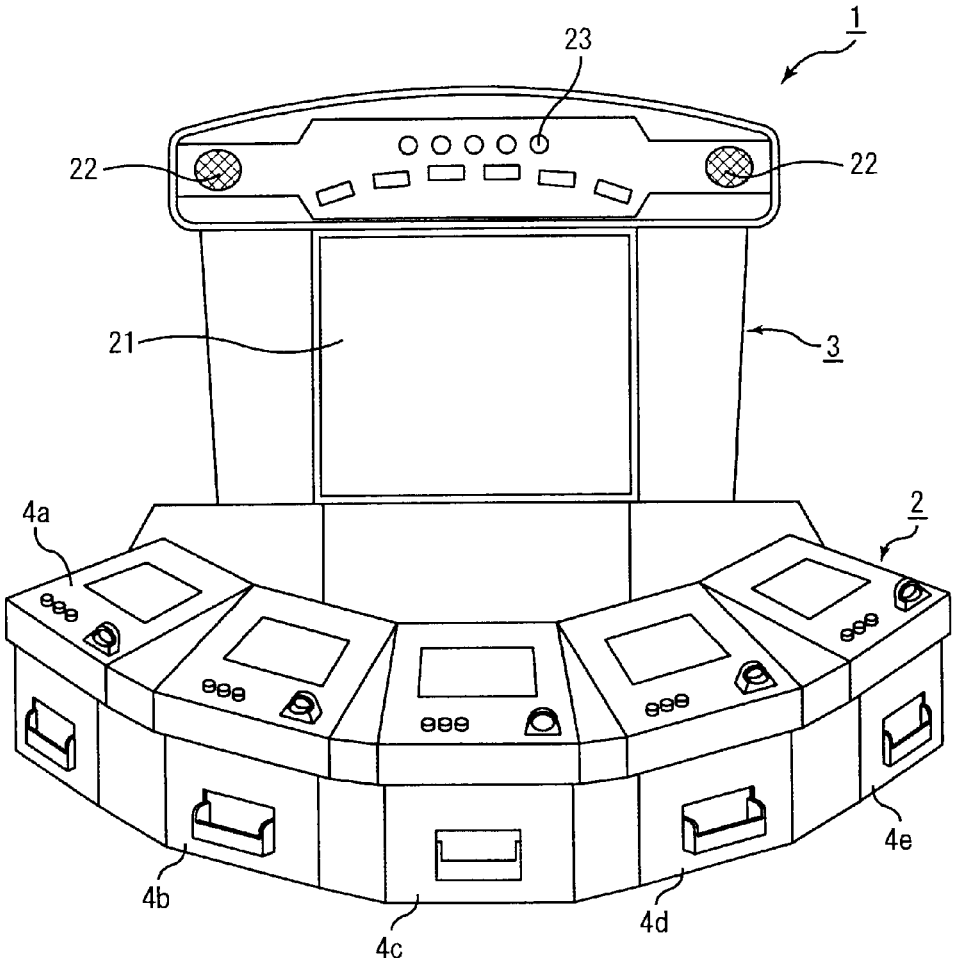
FIG. 3 is an outline view of a gaming machine according to one embodiment of the present invention.

FIG. 3 is an outline view of the gaming machine 1 according to the present embodiment.

The gaming machine 1 according to the present embodiment is provided with a table portion 2 and a panel portion 3. The table portion 2 is a portion enabling players to play a game by taking a seat, and has the plurality of player terminals 4 described above. The panel portion 3 is set up in a front direction of the players taking a seat at the table portion 2. This panel portion 3 is provided with a front display 21, as described later. The front display 21 displays an animation image of a dealer or the like in accordance with the progress of a game.

Next, the table portion 2 constituting the card gaming machine 1 will be described in detail with reference to the accompanying drawings. As shown in FIG. 3, the table portion 2 has the plurality of (five in FIG. 3) player terminals 4 (player terminal 4*a*, player terminal 4*b*, player terminal 4*c*, player terminal 4*d*, player terminal 4*e*) arranged in a general fan shape.

In this context, the structure of one player terminal 4 that constitutes the table portion 2 will be described in detail with reference to an accompanying drawing.

Figure 4:
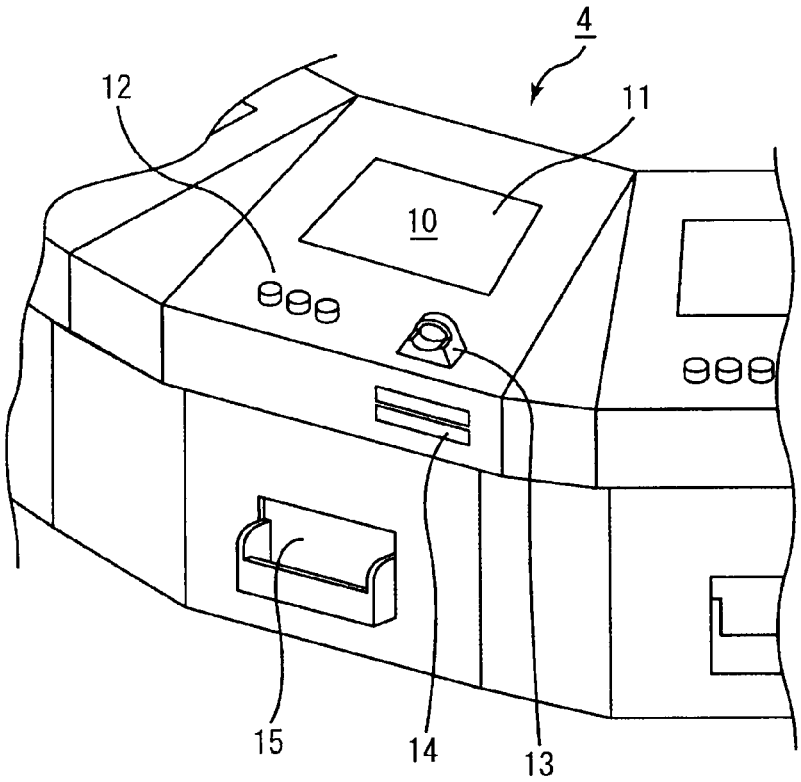
FIG. 4 is an outline view of a player terminal in one embodiment of the present invention.

FIG. 4 is an outline view illustrating one player terminal 4 according to one embodiment of the present embodiment.

Each of the player terminals 4 constituting the table portion 2 has the same structure.

As shown in FIG. 4, one player terminal 4 includes a liquid crystal display 10, a touch panel 11, operation buttons 12, a coin insertion slot 13, a bill insertion slot 14, and a coin exit 15. The liquid crystal display 10 is a display device that displays a game screen (see FIG. 1 and FIG. 7), the results of the game or the like described later. The touch panel 11 is arranged on the front face of the liquid crystal display 10. The touch panel 11 is used to select a bet target or to set a bet amount with a game screen 70 displayed on the liquid crystal display 10. That is, the touch panel 11 functions as an operating unit for selecting the bet target or setting the bet amount. The operation buttons 12 are operating units for making operations such as a payout operation in the gaming machine 1. The coin insertion slot 13 is a portion for a player to insert coins or medals. The bill insertion slot 14 is a portion for a player to insert bills. Further, the coin exit 15 is a portion for paying out coins or medals corresponding to accumulated credits when a player makes a payout operation.

The panel portion 3 constituting the gaming machine 1 includes a front display 21, speakers 22, and LEDs 23. The front display 21 is a display device that displays an image in accordance with the progress of the game. Specifically, the front display 21 displays images such as an image of a dealer distributing cards or exchanging chips. The front display 21 also displays the fronts of distributed cards. The speakers 22 output music and/or sound effects in accordance with the progress of the game. These speakers 22 are set up at the upper portion of the front display 21. The LEDs 23 are a light emitting device that is lit at the time of various effects, and enhances the sense of reality of the game by emitting light in various modes for the effects.

Next, the structure according to a control system of the gaming machine 1 will be described in detail with reference to an accompanying drawing.

Figure 5:
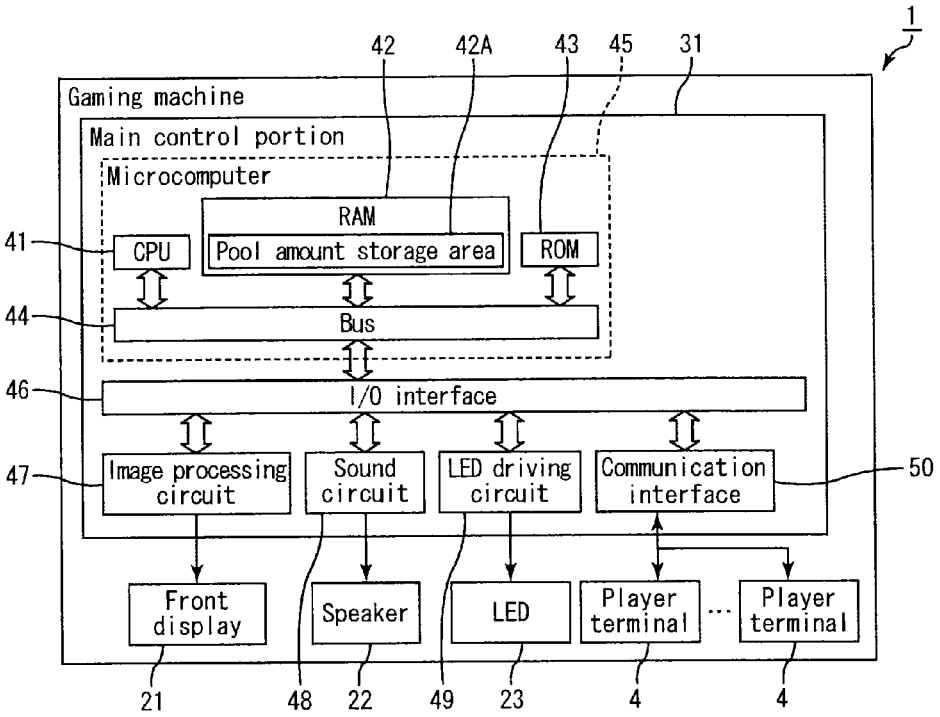
FIG. 5 is a block diagram schematically illustrating a control system of the gaming machine according to one embodiment of the present invention.

FIG. 5 is a block diagram schematically illustrating a control system of the gaming machine according to one embodiment of the present invention.

As illustrated in FIG. 5, the gaming machine 1 includes a main control portion 31, the plurality of player terminals 4 connected to the main control portion 31, and a variety of peripheral devices.

The main control portion 31 basically includes a microcomputer 45 as a core. This microcomputer 45 includes a CPU 41, a RAM 42, a ROM 43, and a bus 44 for transmitting data among the CPU 41, the RAM 42 and the ROM 43. The ROM 43 stores various programs necessary for executing processing to control the gaming machine 1, and data tables. The CPU 41 is a calculating unit that executes various control programs. The CPU 41 is primarily responsible in control of the respective driving circuits by the microcomputer 45. The RAM 42 is a memory for temporarily storing a variety of data calculated by the CPU 41. The ROM 43 stores image data of the fronts and the backs of cards used as the player cards and the banker cards.

The ROM 43 further stores squeeze image data for each of the 52 playing cards. The squeeze image data shows moving images (squeeze images) of the playing cards being turned over (see FIG. 1B).

Also, the ROM 43 stores a baccarat game program for determining a game result based on the baccarat rules (see FIG. 12 and FIG. 13).

The CPU 41 is also connected through an I/O interface 46 to an image processing circuit 47, a sound circuit 48, an LED driving circuit 49, and a communication interface 50. The image processing circuit 47 is a circuit for controlling a display mode of the front display 21, based on control by the CPU 41. Therefore, performing a display control of the front display 21 through the image processing circuit 47 displays images such as a dealer image 102 on the front display 21 (see FIG. 3). The sound circuit 48 is a circuit for performing a drive control of the speakers 22, based on control by the CPU 41. In other words, controlling the speakers 22 through the sound circuit 48 outputs the music and sound effects according to the progress of the game. The LED driving circuit 49 is a circuit for controlling illumination modes of the LEDs 23. Therefore, controlling the illumination modes of the LEDs 23 through the LED driving circuit 49 enables production of effects corresponding to the progress of the game.

The communication interface 50 is an interface that allows each player terminal 4 to transmit and receive various data to and from the main control portion 31. Therefore, a variety of information such as betting operation information from each player terminal 4 is transmitted and received to and from the main control portion 31 through the communication interface 50.

Next, the control system of the player terminals 4 according to the present embodiment will be described in detail with reference to an accompanying drawing.

Figure 6:
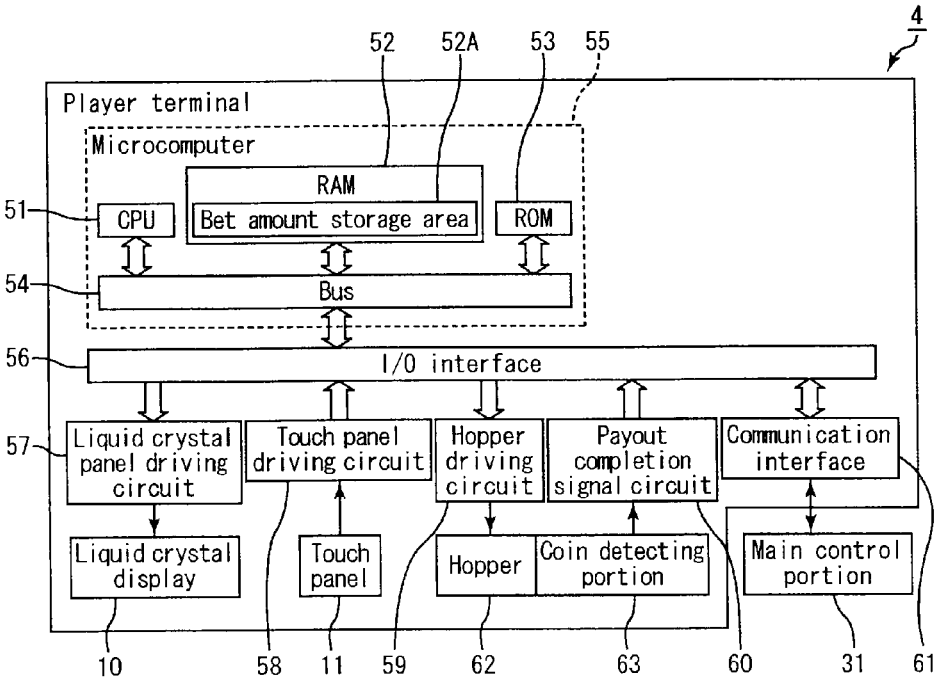
FIG. 6 is a block diagram schematically illustrating a control system of each player terminal according to one embodiment of the present invention.

FIG. 6 is a block diagram schematically illustrating the control system of each player terminal 4 according to one embodiment of the present invention.

As illustrated in FIG. 6, each player terminal 4 according to the present embodiment includes a microcomputer 55 as a core. The microcomputer 55 includes a CPU 51, a RAM 52, a ROM 53, and a bus 54 for transmitting data among the CPU 51, the RAM 52, and the ROM 53. The ROM 53 stores various programs necessary for executing processing to control the player terminal 4, and data tables.

The ROM 53 stores player card I display area address information and player card II display area address information. The player card I display area address information is information that shows the X coordinate range and the Y coordinate range corresponding to the player card I display area (see FIG. 1A and FIG. 2). The player card II display area address information is information that shows the X coordinate range and the Y coordinate range corresponding to the player card II display area (see FIG. 1A and FIG. 2).

The ROM 53 also stores contact effective area I address information and contact effective areas II address information. The contact effective area I address information is information that shows the x coordinate range and the y coordinate range corresponding to the contact effective area I (see FIG. 1C and FIG. 2). The contact effective area II address information is information that shows the x coordinate range and the y coordinate range corresponding to the contact effective area II (see FIG. 1C and FIG. 2).

The CPU 51 is a calculating unit that executes a variety of control programs stored in the ROM 53. The CPU 51 is primarily responsible in control of the respective driving circuits by the microcomputer 55. The RAM 52 is a memory for temporarily storing a variety of data calculated by the CPU 51. The RAM 52 has a bet amount storage area 52A provided therein. The bet amount storage area 52A stores a credit amount currently accumulated in the player terminal 4, a bet target betted by a player (i.e., "PLAYER", "BANKER", or "TIE"), and the bet amount (credit amount) betted on the bet target.

The CPU 51 is connected through an I/O interface 56 to a liquid crystal panel driving circuit 57, a touch panel driving circuit 58, a hopper driving circuit 59, a payout completion signal circuit 60, and a communication interface 61. The liquid crystal panel driving circuit 57 is connected to the liquid crystal display 10, and is used for controlling display modes of the liquid crystal display 10. The touch panel driving circuit 58 is connected to the touch panel 11, detects the operation of the touch panel 11 by a player, and is used for providing control that corresponds to the operation. The hopper driving circuit 59 is connected to a hopper 62, and is used for controlling the hopper 62 at the time of paying out coins to the coin exit 15. The payout completion signal circuit 60 is connected to a coin detecting portion 63. Upon payout of a predetermined number of coins to the coin exit 15, the payout completion signal circuit 60 transmits a payout completion signal indicating that payout has completed.

The communication interface 61 is an interface that allows the player terminal 4 to transmit and receive a variety of information to and from the main control portion 31. For example, betting information based on operation information outputted from the touch panel 11 is transmitted to the main control portion 31 through the communication interface 61.

Next, with reference to an accompanying drawing, a detailed description will be given with respect to the game screen 70 displayed on the liquid crystal display 10 of each player terminal 4 when baccarat is executed in the gaming machine 1 according to the present embodiment.

Figure 7:
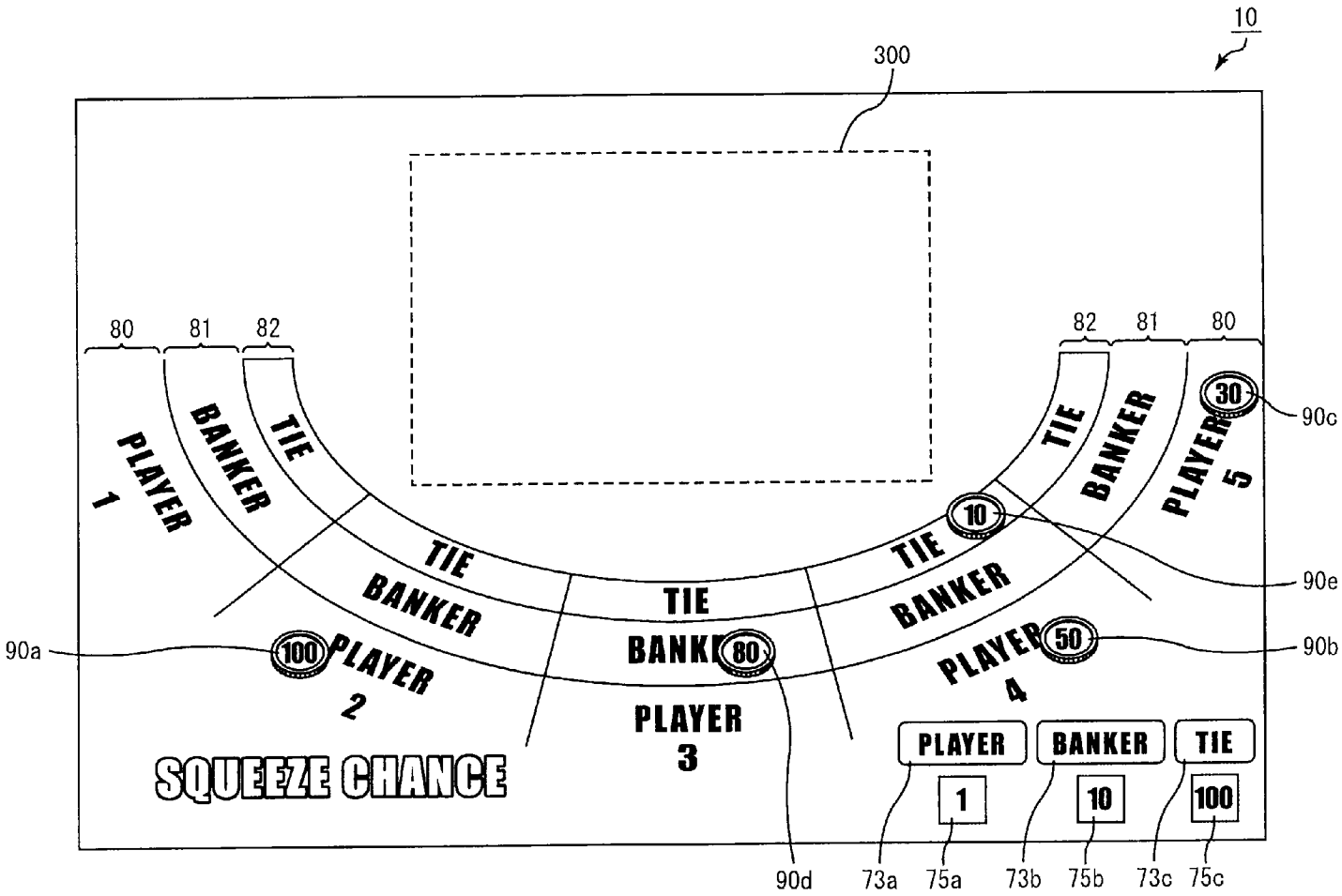
FIG. 7 is an explanatory view illustrating a game screen displayed on the liquid crystal display of one of the player terminals according to one embodiment of the present invention.

FIG. 7 is an explanatory view illustrating a game screen displayed on a liquid crystal display of one of the player terminals 4.

In this context, in the gaming machine 1 according to the present embodiment, a player performs a betting operation by using the game screen 70 and the touch panel 11. This betting operation is an operation of betting a predetermined amount of credits on a current game.

As illustrated in FIG. 7, the game screen 70 is provided with the game result determination card display area 300. In the game result determination card display area 300, the player cards 301 and the banker cards 302 are displayed as illustrated in FIG. 1A and FIG. 1B.

Below the game result determination card display area 300, "PLAYER" bet areas 80, "BANKER" bet areas 81, and "TIE" bet areas 82 are provided for the respective player terminals 4. A bet placed on "PLAYER" leads to display of a coin image in the "PLAYER" bet area 80. A bet placed on "BANKER" leads to display of a coin image in the "BANKER" bet area 81. A bet placed on "TIE" leads to display of a coin image in the "TIE" bet area 82.

In the example of FIG. 7, a coin image 90*a*, displayed in the "PLAYER" bet area 80 corresponding to the player terminal 4*b*, shows that the bet of 100 credits is placed on "PLAYER" from the player terminal 4*b*. A coin image 90*b*, displayed in the "PLAYER" bet area 80 corresponding to the player terminal 4*d*, shows that the bet of 50 credits is placed on "PLAYER" from the player terminal 4*d*. A coin image 90*c*, displayed in the "PLAYER" bet area 80 corresponding to the player terminal 4*e*, shows that the bet of 30 credits is placed on "PLAYER" from the player terminal 4*e*. A coin image 90*d*, displayed in the "BANKER" bet area 81 corresponding to the player terminal 4*c*, shows that the bet of 80 credits is placed on "BANKER" from the player terminal 4*c*. A coin image 90*e*, displayed in the "TIE" bet area 82 corresponding to the player terminal 4*d*, shows that the bet of ten credits is placed on "TIE" from the player terminal 4*d*.

In the lower right portion of the liquid crystal display 10, bet button images 73 ("PLAYER" bet button image 73*a*, "BANKER" bet button image 73*b*, "TIE" bet button image 73*c*) and bet amount button images 75 ("1 credit" button image 75*a*, "10 credit" button image 75*b*, "100 credit" button image 75*c*) are displayed.

By touching a position on the touch panel 11 corresponding to any of the bet button images 73, a player can choose a bet object in a current game of baccarat. Also, touching a position on the touch panel 11 corresponding to any of the bet amount button images 75, the player can choose the amount of a bet for the current game of baccarat.

Note that the button images such as the bet button images 73 and the bet amount button images 75 are also referred to simply as buttons herein.

Touching a position on the touch panel 11 corresponding to any of the button images is also referred to as "pressing (turning on) a button". For example, touching a position on the touch panel 11 corresponding to the "PLAYER" bet button image 73*a* is also referred to as "pressing (turning on) the "PLAYER" bet button". Further, touching a position on the touch panel 11 corresponding to the "100 credit" button image 75*c* is also referred to as "pressing (turning on) the "100 credit" button".

Furthermore, touching a position on the touch panel 11 corresponding to any of the button images is also referred to as "touching a button".

Next, with reference to accompanying drawings, a detailed description will be given with respect to game processing programs executed in the gaming machine 1 having the above structure according to the present embodiment, namely, a game processing program executed by the CPU 41 of the main control portion 31 and a game processing program at the player terminal side which is executed by the CPU 51 of each player terminal 4.

First, with reference to FIG. 8 and FIG. 9, the game processing program executed by the main control portion 31 will be described.

When the main control portion 31 starts the game processing program, the CPU 41 first transmits a betting period start command to each player terminal 4 (step S1). This betting period start command is a command for starting acceptance of a betting operation by a player at each player terminal 4.

After that, when the processing proceeds to step S2, the CPU 41 receives betting information transmitted from each player terminal 4. In this context, the betting information includes information relating to the bet target and the bet amount (credit amount). Upon reception of the betting information, the CPU 41 stores the betting information into the RAM 42, for each player terminal 4, and then advances the processing to step S3.

Next, the CPU41 identifies the player terminal 4 with the largest bet amount on "PLAYER", based on the bet information of the respective player terminals 4 stored in the RAM 42, and transmits a largest bet signal to the identified player terminal 4 (step S3). Upon reception of the largest bet signal, the player terminal 4 of the largest bet amount on "PLAYER" allows the player to input a command (squeeze command) to turn over a card.

After that, the CPU 41 executes initial card lottery processing (step S4). Initial cards include two player cards and two banker cards (see FIG. 1A).

The initial card lottery processing (step S4) is for determining cards to be associated with each player and the banker by lottery. In baccarat, six decks or eight decks of playing cards are used. One deck of playing cards has 52 cards each assigned with a number and a suit described above. Accordingly, in the initial card lottery processing (step S4), the CPU 41 randomly associates N cards (for example, N=312 if 6 decks are used), to be used in one game, with any number from 1 to N (distribution order). The CPU 41 associates cards with the players and the banker based on the thus-determined distribution order.

Note that, in the processing, the CPU 41 stores into the RAM 42 the player card I information showing the number and the suit associated with the player card I and the player card II information showing the number and the suit associated with the player card II.

In step S5 after the initial card lottery processing (step S4), the CPU 41 transmits initial card information to the player terminals 4, based on a lottery result of the initial card lottery processing (step S4). The initial card information includes information of numbers and suits (such as "7 of Hearts", "A of Spades", for example) associated with the respective two player cards and two banker cards.

After transmitting the initial card information to the player terminals 4, the CPU 41 executes dealer image effect processing (step S6). Specifically, the CPU 41 controls the front display 21 and produces an effect of displaying an image of the dealer distributing cards so as to display two player cards and two banker cards face down.

Next, the CPU 41 executes squeeze display processing (step S7). The squeeze display processing will be described later with reference to FIG. 11.

Next, the CPU 41 determines whether or not predetermined time has elapsed after executing the processing of step S6 (step S8). When determining that predetermined time has not elapsed, the CPU 41 returns the processing to step S7.

When determining that predetermined time has elapsed, the CPU 41 displays the two player cards and the two banker cards face up (step S9).

Next, the CPU 41 executes game result determination processing based on the baccarat game program stored in the ROM 43 (step S10).

Figure 8:
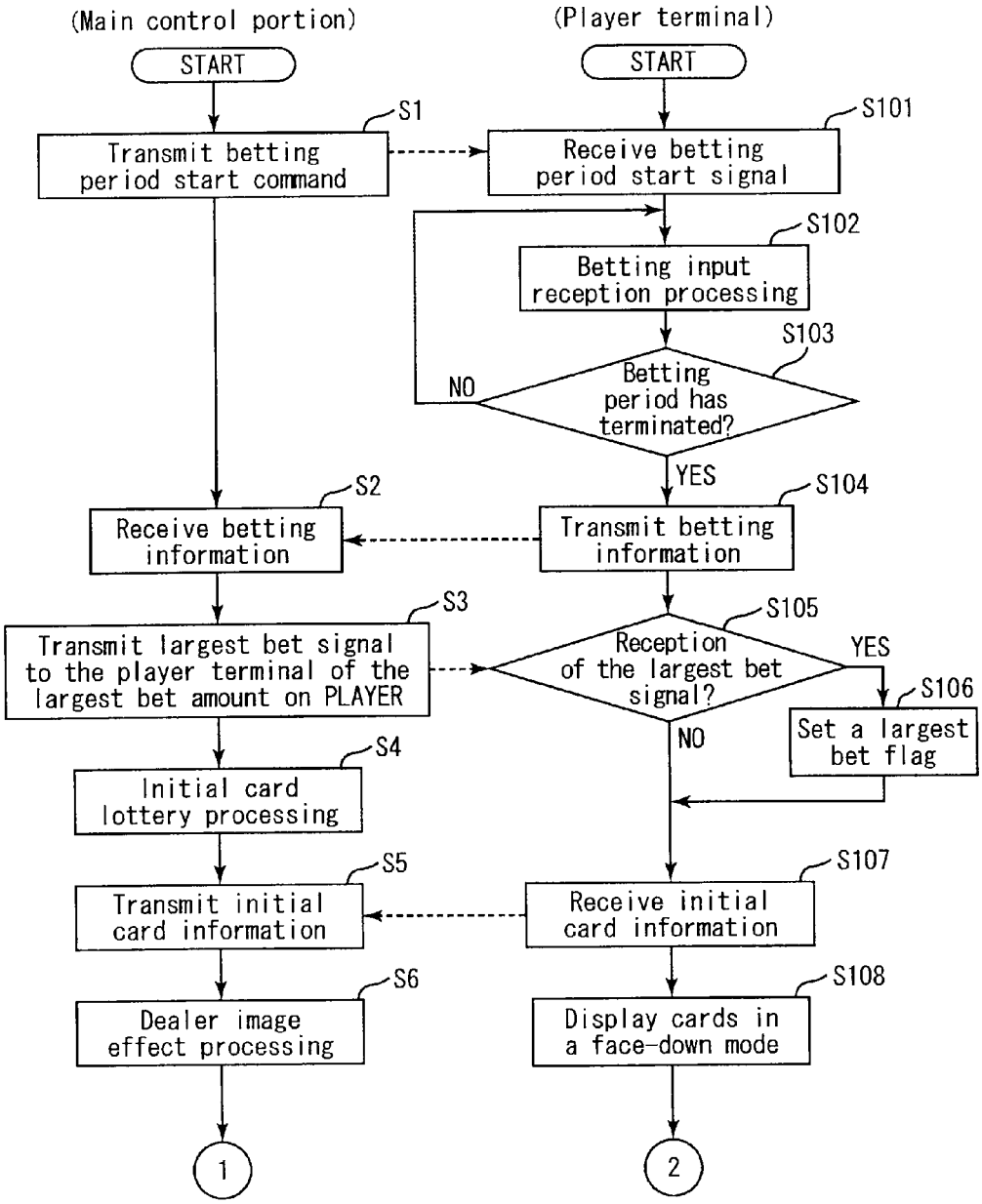
FIG. 8 is a flowchart of a game processing program of the gaming machine.

In the processing, the CPU 41 determines whether or not to display a third player card based on the baccarat rules, and when determining to display, the CPU 41 determines a card for the third player card based on the distribution order determined in step S4 of FIG. 8. The CPU 41 then transmits information showing the determined card to the player terminals 4 and also displays this card face up on the front display 21.

The CPU 41 also determines whether or not to display a third banker card based on the baccarat rules, and when determining to display, the CPU 41 determines a card for the third banker card based on the distribution order determined in step S4 of FIG. 8. The CPU 41 then transmits information showing the determined card to the player terminals 4 and also displays this card face up on the front display 21.

The CPU 41 compares the point calculated based on the two or three player cards with the point calculated based on the two or three banker cards so as to determine the game result as "PLAYER", "BANKER", or "TIE".

The baccarat rules will be described in detail later with reference to FIG. 12 and FIG. 13.

Thereafter, the CPU 41 transmits information showing the determined game result to the player terminals 4 and ends the game processing program in the main control portion 31.

Next, the game processing program executed at the player terminals 4 side will be described with reference to FIG. 8 and FIG. 9.

When execution of the game processing program is started, each CPU 51 receives in S101 the betting period start command from the main control portion 31.

After that, the processing is shifted to step S102 and the CPU 51 displays the game screen 70 (see FIG. 7) on the liquid crystal display 10 (step S102). This allows the player to perform a betting operation at the player terminal 4. When the player performs the betting operation, the CPU 51 identifies the bet target and the bet amount (credit amount) based on the operation information from the bet buttons 73 and the bet amount buttons 75. Then, the CPU 51 stores into the RAM 52 the identified bet target and the bet amount as the bet information, and shifts the processing to step S103.

In step S103, the CPU 51 determines whether or not the betting period has terminated. Specifically, the CPU 51 determines whether or not predetermined given time (20 seconds, for example) has elapsed since the start of the acceptance of the betting operation (i.e., since reception of the betting period start command). When the betting period has terminated (step S103: YES), the CPU 51 advances the processing to step S104. On the other hand, when the betting period has not terminated (step S103: NO), the CPU 51 continuously accepts the betting operation.

When the processing is shifted to step S104, the CPU 51 stores the current betting information in the RAM 52, and transmits the betting information to the main control portion 31. The betting information includes information relating to the bet target and the bet amount (credit amount) betted by the player.

Next, the CPU 51 determines whether or not it has received a largest bet signal (see step S3) from the main control portion 31 (step S105).

When determining that the CPU 51 has received the largest bet signal, the CPU 51 sets a largest bet flag in the RAM 52 (step S106).

When determining that the CPU 51 has not received the largest bet signal in step S105, or after executing the processing of step S106, the CPU 51 receives initial card information (step S107). The initial card information to be received is information that is transmitted from the main control portion 31 to the player terminals 4 in step S5, and shows two player cards and two banker cards. Accordingly, the initial card information includes information on numbers and suits on the initial cards (such as "7 of Hearts", "A of Spades", for example).

Upon reception of the initial card information, the CPU 51 displays initial cards face down in the game result determination card display area 300 of the game screen 70, based on the initial card information (step S108).

In the processing, the CPU 51 displays one (player card I) of the two player cards face down in the player card I display area (see FIG. 1A), based on the player card I display area address information stored in the ROM 53. The CPU 51 also displays the other (player card II) of the two player cards face down in the player card II display area (see FIG. 1A), based on the player card II display area address information stored in the ROM 53.

Next, the CPU 51 executes squeeze display processing (step S109). The squeeze display processing will be described later in detail with reference to FIG. 10.

Next, the CPU 51 determines whether or not predetermined time has elapsed since execution of the processing of step S108 (step S110). When determining that predetermined time has not elapsed, the CPU 51 returns the processing to step S109.

When determining that predetermined time has elapsed, the CPU 51 displays the two player cards and the two banker cards face up (step S111).

Next, upon reception of information (see step S10) showing the third player card from the main control portion 31, the CPU 51 displays the third player card in the game result determination card display area 300 (step S112). Also, upon reception of information (see step S10) showing the third banker card from the main control portion 31, the CPU 51 displays the third banker card in the game result determination card display area 300.

Next, the CPU 51 receives game result information (information showing "PLAYER", "BANKER", or "TIE") from the main control portion 31 (step S113).

Next, the CPU 51 executes payout processing (step S114). In the payout processing (step S114), the CPU 51 makes an addition to the credit amount or pays out coins, based on the game result information received in step S113.

Now, the squeeze display processing (see step S109 of FIG. 9) executed in the player terminals 4 is described with reference to FIG. 10.

FIG. 10 is a flowchart illustrating a subroutine of the squeeze display processing executed in each player terminal.

First, the CPU 51 determines whether or not the CPU 51 has received a contact detection signal from the touch panel 11 (step S201). A contact detection signal is transmitted upon contact on the touch panel 11, and carries coordinate information corresponding to the position of the contact (contact position). A contact position is represented by an x coordinate and a y coordinate.

When the CPU 51 determines that the CPU 51 has received the contact detection signal, the CPU 51 then determines whether or not a largest bet flag (see step S106 of FIG. 8) is set in the RAM 52 (step S202).

When determining that the largest bet flag is set, the CPU 51 determines whether or not the contact position is within an area (contact effective area I) of the touch panel 11 corresponding to the player card I display area or within an area (contact effective area II) of the touch panel 11 corresponding to the player card II display area (step S203). This determination is made based on the coordinate information carried by the contact detection signal received in step S201, and the contact effective area address information (the contact effective area I address information and the contact effective area II address information) stored in the ROM 53. In the processing, the CPU 51 determines whether or not the x coordinate of the contact position satisfies $10 \leq x \leq 30$ or $40 \leq x \leq 60$ and, the y coordinate of the contact position satisfies $20 \leq y \leq 60$.

When determining that the contact position is within the contact effective area I or the contact effective area II, the CPU 51 identifies within which of the contact effective area I and the contact effective area II the contact position is located (step S204).

In the processing, the CPU 51 identifies the contact effective area I in the case where the x coordinate of the contact position satisfies $10 \leq x \leq 30$. Alternatively, in the case where the x coordinate of the contact position satisfies $40 \leq x \leq 60$, the CPU 51 identifies the contact effective area II.

Next, the CPU 51 transmits a squeeze image data request signal to the main control portion 31 (step S205). A squeeze image data request signal is a signal showing a request for transmission of squeeze image data.

The squeeze image data request signal carries information (player card identification information) showing a player card (player card I or player card II). When the CPU 51 has identified the contact effective area I in step S204, the signal carries information showing the player card I. When the CPU 51 has identified the contact effective area II in step S204, the signal carries information showing the player card II.

Figure 9:
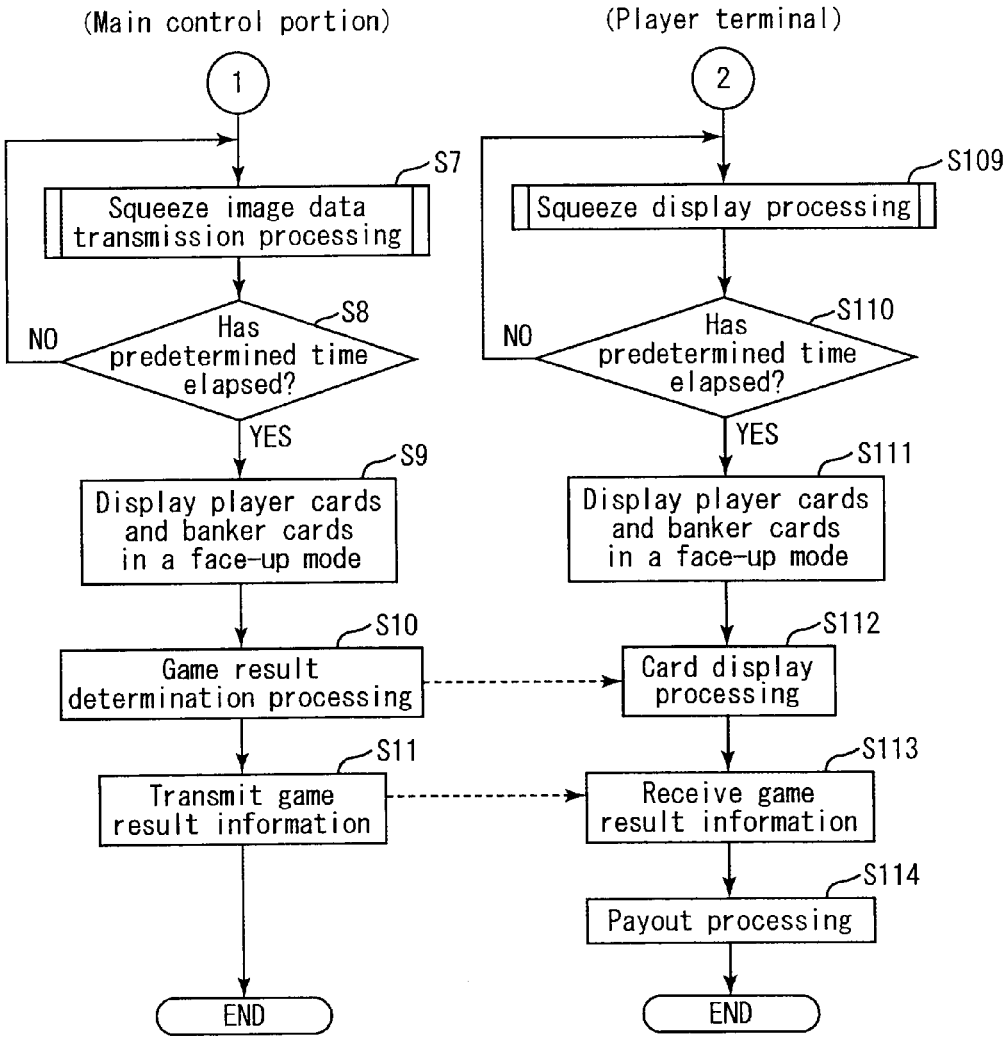
FIG. 9 is another flowchart of the game processing program of the gaming machine according to one embodiment of the present invention.

Upon reception of the squeeze image data request signal, the main control portion 31 executes squeeze image data transmission processing (see step S7 of FIG. 9).

Here, the squeeze image data transmission processing (see step S7 of FIG. 9) is described.

Figure 11:
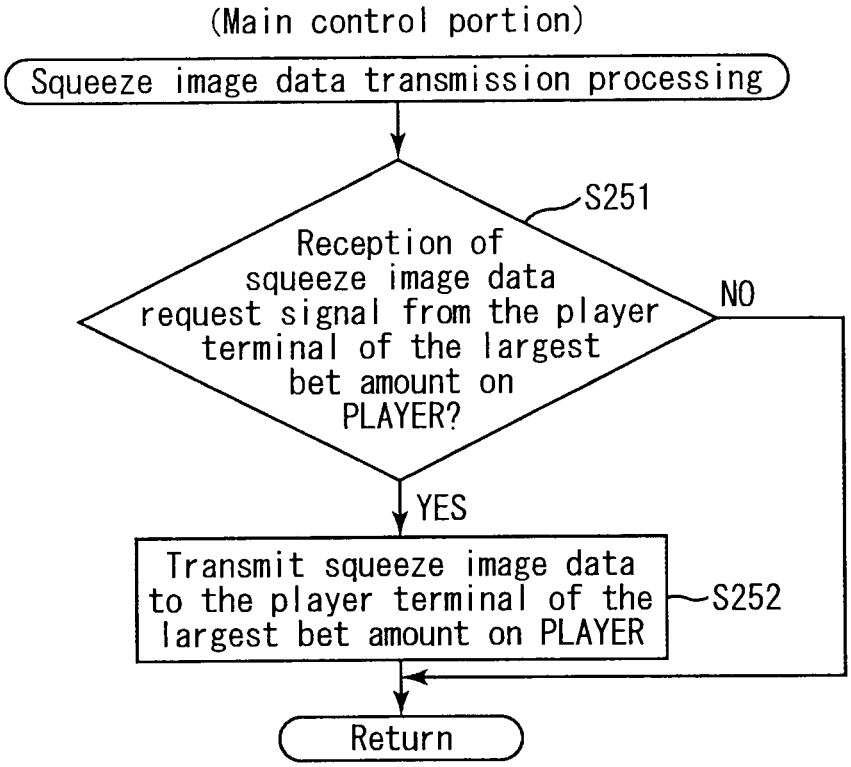
FIG. 11 is a flowchart illustrating a subroutine of squeeze image data transmission processing executed in a main control portion according to the first embodiment.

FIG. 11 is a flowchart illustrating a subroutine of the squeeze image data transmission processing executed in the main control portion.

First, the CPU 41 determines whether or not the CPU 41 has received a squeeze image data request signal from the player terminal 4 of the largest bet amount on "PLAYER" (step S251).

When determining that the CPU 41 has received a squeeze image data request signal, the CPU41 identifies squeeze image data corresponding to the player card I or the player card II from the 52 squeeze image data stored in the ROM 43. The image data is identified based on the player card identification information carried by the squeeze image data request signal, and the player card I information or the player card II information (see step S4 of FIG. 8) stored in the RAM 42.

Then, the CPU 41 transmits the identified squeeze image data to the player terminal 4 from which the above squeeze image data request signal has been transmitted (step S252).

When the CPU 41 determines in step S251 that the CPU 41 has not received the squeeze image data request signal, or after executing the processing of step S252, the CPU41 ends the present subroutine.

In the above, the squeeze image data transmission processing executed in the main control portion has been described with reference to FIG. 11.

Now, refer back to FIG. 10.

After executing the processing of step S205, the CPU 51 receives the squeeze image data from the main control portion 31 (step S206).

The CPU 51 then displays a moving image showing a scene that the card is turned over based on the received squeeze image data, instead of displaying the card face down, in the player card display area corresponding to the contact effective area identified in step S204 (step S207).

The CPU 51 ends the present subroutine when determining in step S201 that the CPU 51 has not received the contact detection signal from the touch panel 11, when determining in step S202 that the largest bet flag is not set, when determining in step S203 that the contact position is not within either the contact effective area I or the contact effective area II, or after executing the processing of step S207.

In the above, the squeeze display processing (see step S109 of FIG. 9) executed in the player terminals 4 has been described with reference to FIG. 10 and FIG. 11.

Next, the baccarat rules are described with reference to FIG. 12 (FIG. 12A to FIG. 12D) and FIG. 13 (FIG. 13A to FIG. 13D).

FIG. 12A to FIG. 12D are views for explaining the baccarat rules.

FIG. 13A to FIG. 13D are views illustrating an example of player cards and banker cards.

In baccarat, each number assigned to each playing card is associated with a point as illustrated in FIG. 12A. A game result is determined by comparing the ones digit of the total point of the two or three player cards with the ones digit of the total point of the two or three banker cards.

The ones digit of the total point of the two player cards is the determinant factor of display/non-display of the third player card after the two player cards and the two banker cards are displayed, as illustrated in FIG. 12B.

Thereafter, whether or not to display the third banker card is determined. As illustrated in FIG. 12C and FIG. 12D, the ones digit of the total point of the two banker cards, display/non-display of the third player card, and the point of the third player card are the determinant factors of display/non-display of the third banker card.

Although not illustrated, the third banker card is not displayed regardless of the ones digit of the total point of the two banker cards in the case where the ones digit of the total point of the two player cards is 8 or 9. Also, the third player card is not displayed regardless of the ones digit of the total point of the two player cards in the case where the ones digit of the total point of the two banker cards is 8 or 9.

Figure 13A:
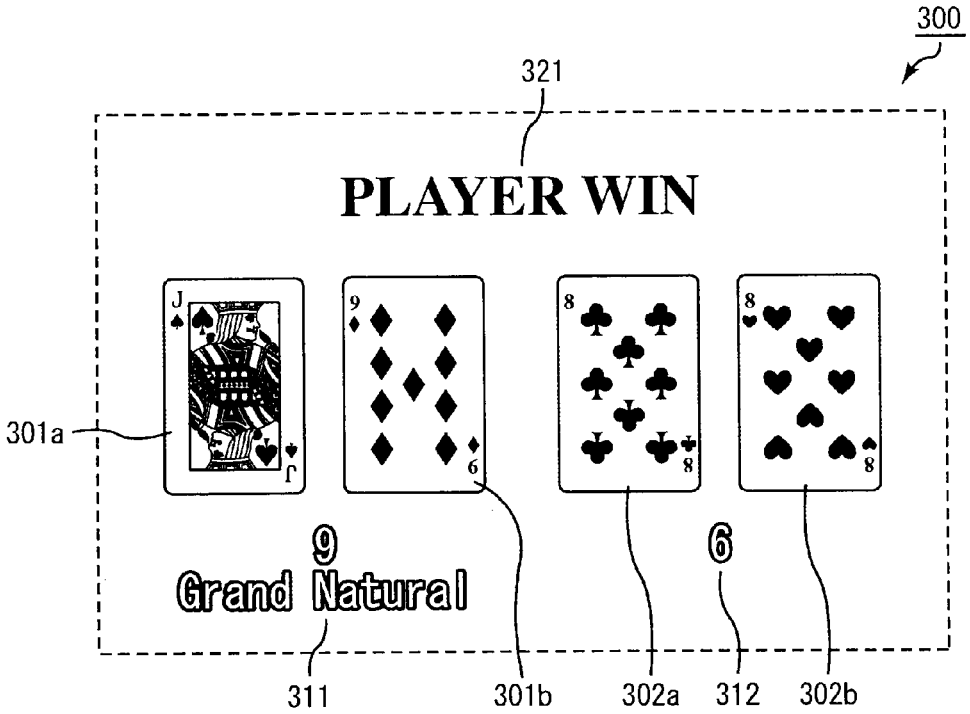
FIG. 13A is a view illustrating an example of player cards and banker cards.

The example of FIG. 13A shows that the game result is determined as "PLAYER" based on the ones digit (9) of the total point of the two player cards and the ones digit (6) of the total point of the two banker cards.

Figure 13B:
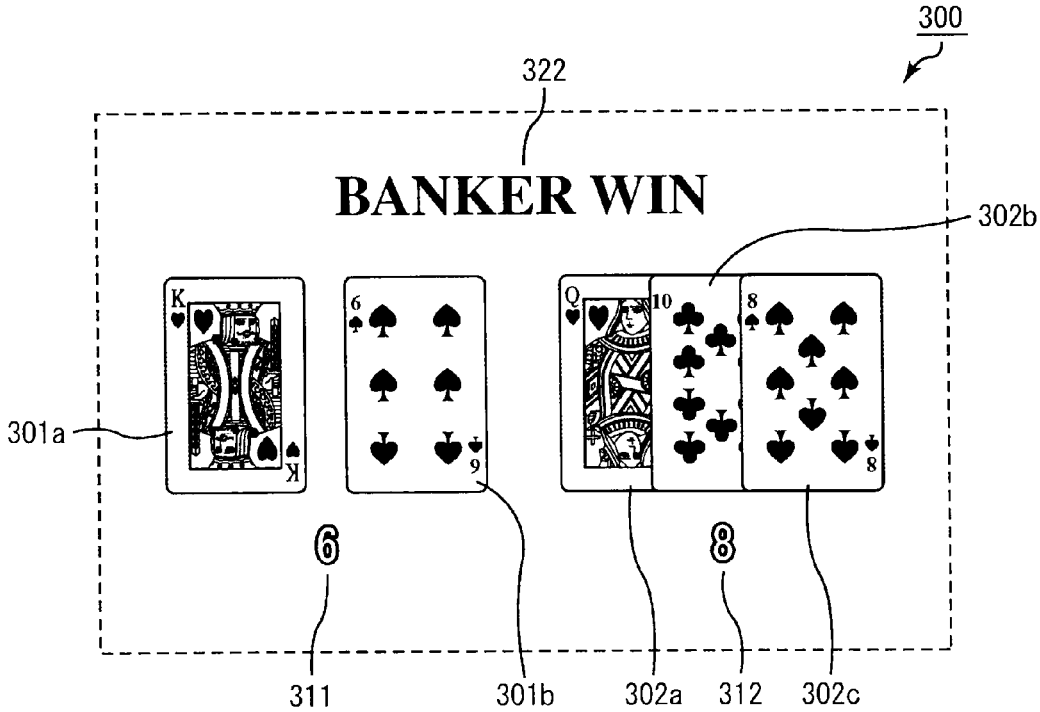
FIG. 13B is a view illustrating another example of player cards and banker cards.

The example of FIG. 13B shows that the game result is determined as "BANKER" based on the ones digit (6) of the total point of the two player cards and the ones digit (8) of the total point of the two banker cards.

Figure 13C:
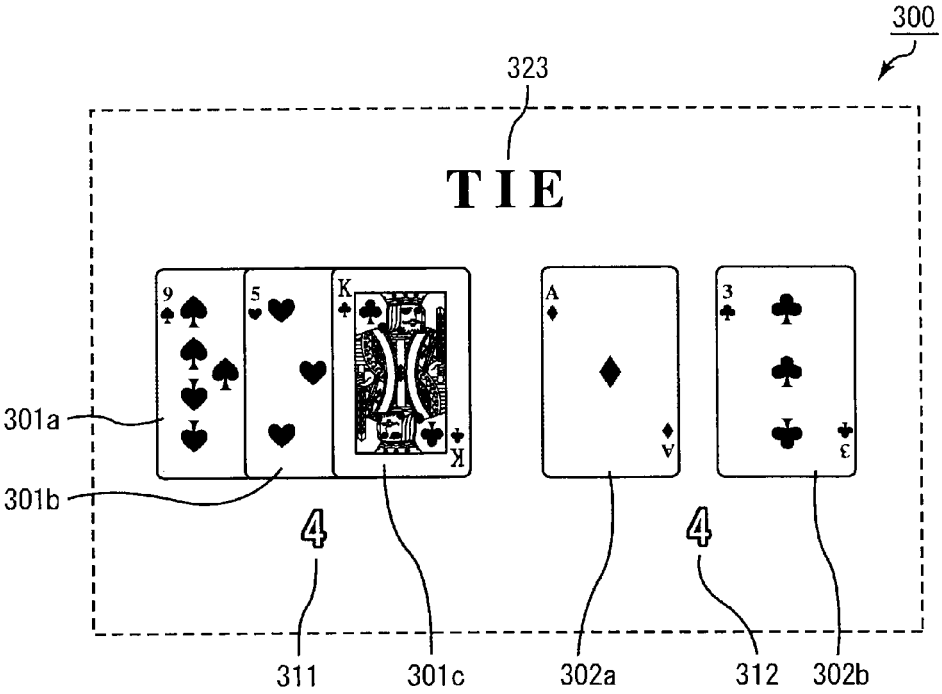
FIG. 13C is a view illustrating another example of player cards and banker cards.

The example of FIG. 13C shows that the game result is determined as "TIE" based on the ones digit (4) of the total point of the three player cards and the ones digit (4) of the total point of the two banker cards.

Figure 13D:
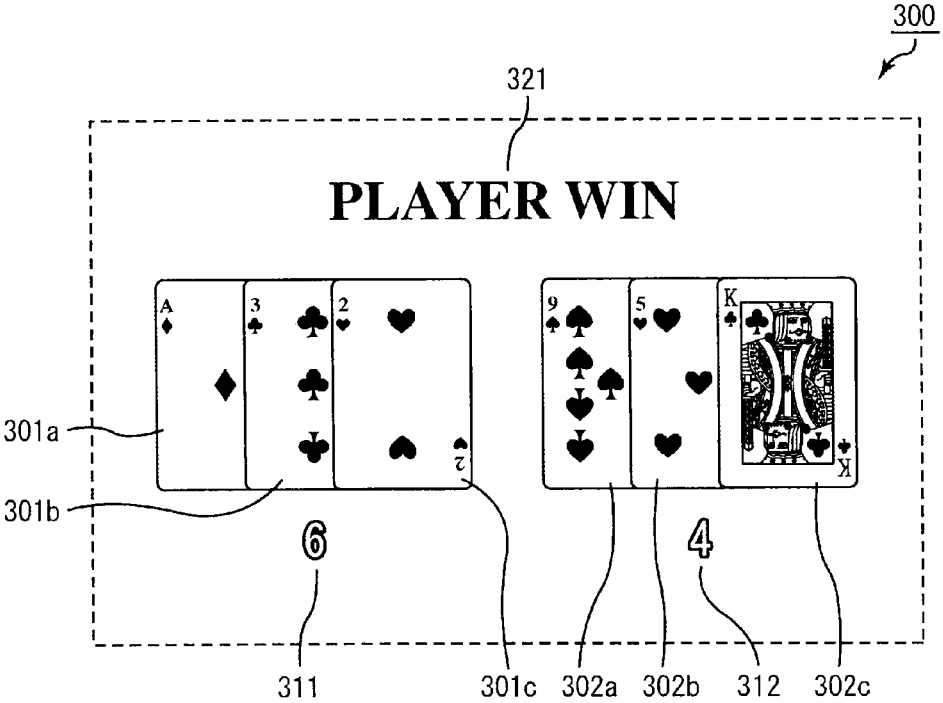
FIG. 13D is a view illustrating yet another example of player cards and banker cards.

The example of FIG. 13D shows that the game result is determined as "PLAYER" based on the ones digit (6) of the total point of the three player cards and the ones digit (4) of the total point of the two banker cards.

In the above, the first embodiment has been described with reference to FIG. 1 to FIG. 13.

According to the gaming machine 1 of the first embodiment and the control method thereof, a determination is made whether or not the position (contact position) on the touch panel, corresponding to the coordinate information carried by the contact detection signal received from the touch panel 11, is within the area (contact effective area I) of the touch panel 11 corresponding to the player card I display area, or within the area (contact effective area II) of the touch panel 11 corresponding to the player card II display area. When a determination is made that the contact position is within the contact effective area I or the contact effective area II, which of the contact effective area I and the contact effective area II includes the contact position is identified. Then, the display mode of the card displayed in the player card display area corresponding to the identified contact effective area is changed to the display mode that enables a part of the front of the card to be viewable.

That is, the scene is displayed in which the face-down card is turned over. Such a scene is displayed upon contact on any position as long as the position is within an area (contact effective area) of the touch panel corresponding to the player card display area.

Players therefore can input a command to turn over a card upon touching any position corresponding to the player card display area. This avoids a situation in which the player needs to very carefully perform an operation for turning over a card, making it possible to decrease the possibility that the player finds it troublesome to perform the operation for turning over a card. As a result, it is possible to let a player further enjoy a card game.

[Second Embodiment]

In the following, the same signs are applied to constituent elements that are same as the constituent elements of the gaming machine 1 according to the first embodiment.

Further, omitted are descriptions of parts to which descriptions in the first embodiment are applicable in a second embodiment.

First, a second embodiment is summarized.

In the second embodiment, a squeeze image is displayed when the same contact effective area is touched twice successively. The display speed of the squeeze image can change according to the time interval (contact time interval) between the first contact and the second contact.

FIG. 14 is a view illustrating relationships between contact time intervals and display speeds of a squeeze image.

As illustrated in FIG. 14, the gaming machine 1 according to the second embodiment is configured such that a shorter contact time interval leads to a faster display speed of a squeeze image.

Figure 15A:
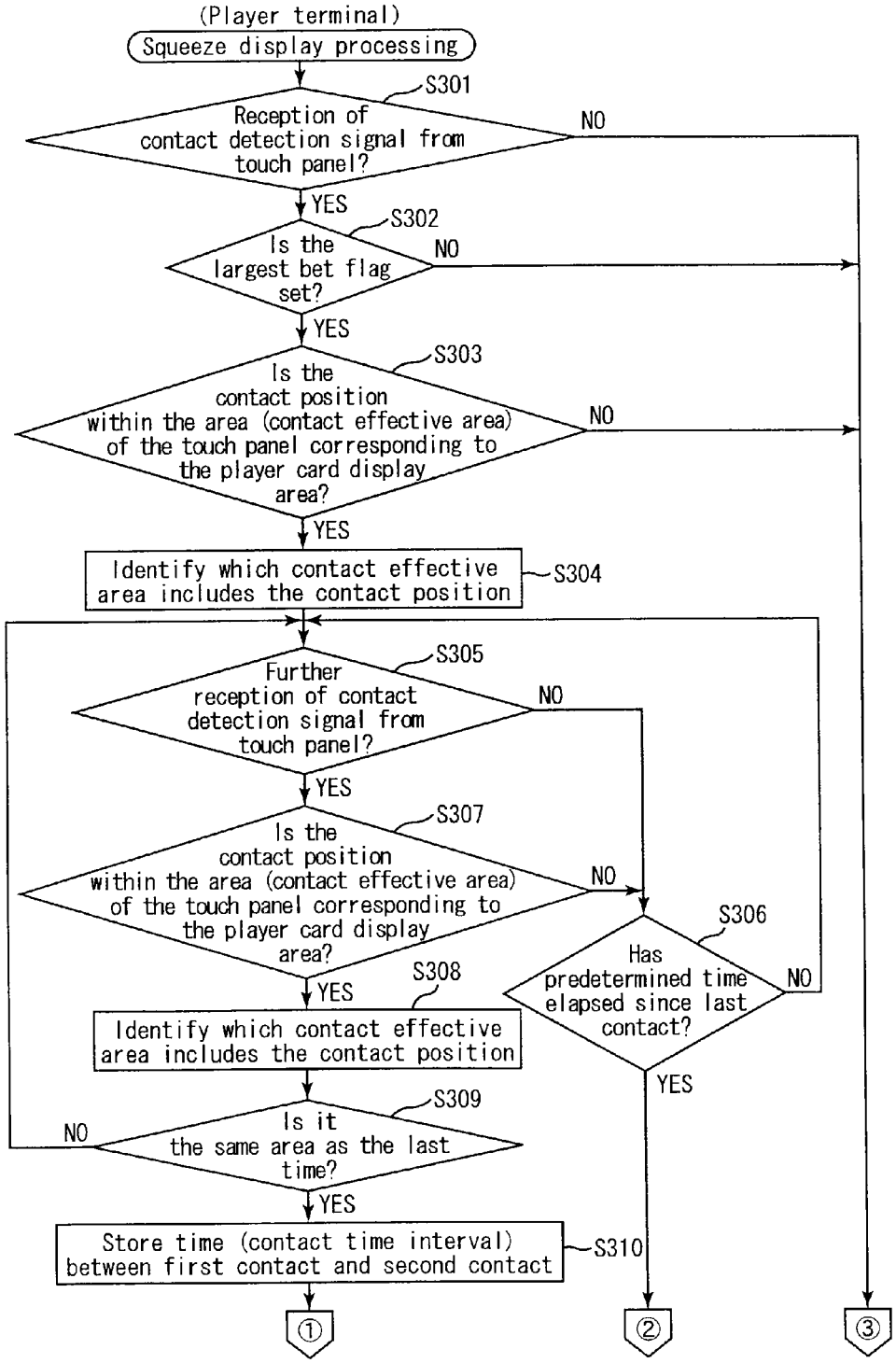
FIG. 15A is a flowchart illustrating a subroutine of squeeze display processing executed in each player terminal according to a second embodiment.
Figure 15B:
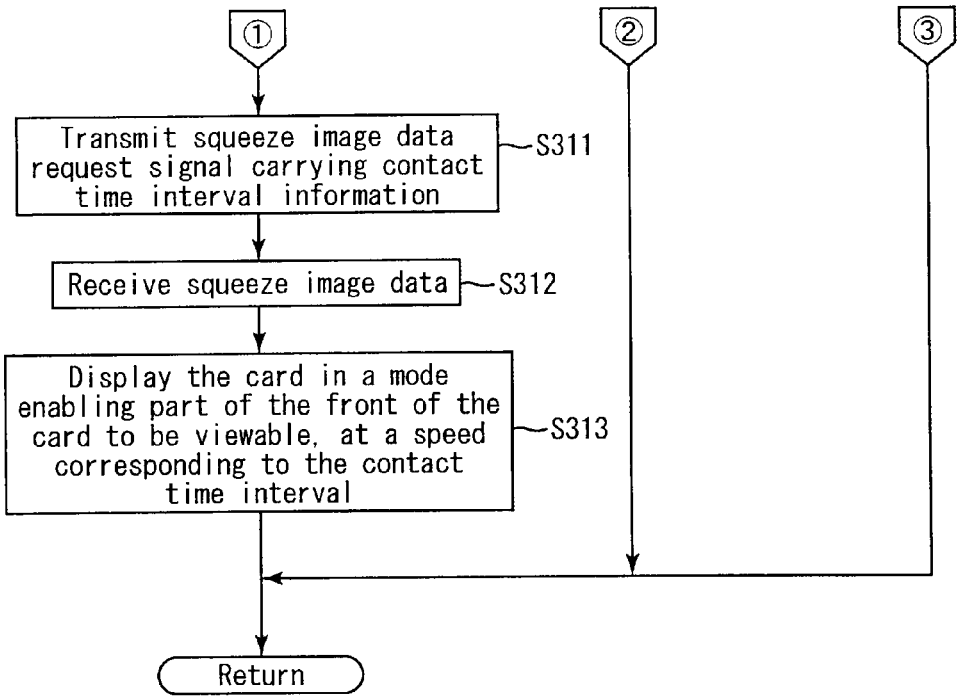
FIG. 15B is another flowchart illustrating the subroutine of the squeeze display processing executed in each player terminal according to the second embodiment.

The squeeze display processing (see step S109 of FIG. 9) according to the second embodiment will be described with reference to FIG. 15 (FIG. 15A and FIG. 15B).

FIG. 15A and FIG. 15B are flowcharts illustrating a subroutine of the squeeze display processing executed at player terminals.

First, the CPU 51 executes the processing of step S301 to step S304. The processing is the same as the processing of step S201 to step S204 of FIG. 10, and thus the descriptions thereof are omitted here.

Subsequently, the CPU 51 determines whether or not the CPU 51 has further received a contact detection signal from the touch panel 11 (step S305).

When the CPU 51 determines that the CPU 51 has further received a contact detection signal from the touch panel 11, the CPU 51 determines whether or not the contact position is within the contact effective area I or the contact effective area II (step S307).

When the CPU 51 determines in step S305 that the CPU 51 has not further received a contact detection signal from the touch panel 11, or when the CPU 51 determines in step S307 that the contact position is not within either the contact effective area I or the contact effective area II, the CPU 51 determines whether or not predetermined time has elapsed after receiving the last contact detection signal (step S306).

When determining that the predetermined time has not elapsed, the CPU51 returns the processing to step S305.

When determining in step S307 that the contact position is within the contact effective area I or the contact effective area II, the CPU 51 identifies within which of the contact effective area I and the contact effective area II the contact position is located (step S308).

Then, the CPU 51 determines whether or not the contact effective area including the current contact position is the same as the contact effective area including the last contact position (step S309).

When determining that the contact effective area including the current contact position is different from the contact effective area including the last contact position, the CPU 51 returns the processing to step S305.

On the other hand, when determining that the contact effective area including the current contact position is the same as the contact effective area including the last contact position, the CPU 51 stores into the RAM 52 the time (contact time interval) from reception of the last contact detection signal to reception of the current contact detection signal (step S310).

Next, the CPU 51 transmits a squeeze image data request signal to the main control portion 31 (step S311).

The squeeze image data request signal according to the second embodiment includes information showing a contact time interval (contact time interval information), as well as player card identification information.

Upon reception of the squeeze image data request signal, the main control portion 31 executes squeeze image data transmission processing (see step S7 of FIG. 9).

Here, the squeeze image data transmission processing (see step S7 of FIG. 9) according to the second embodiment is described.

Figure 16:
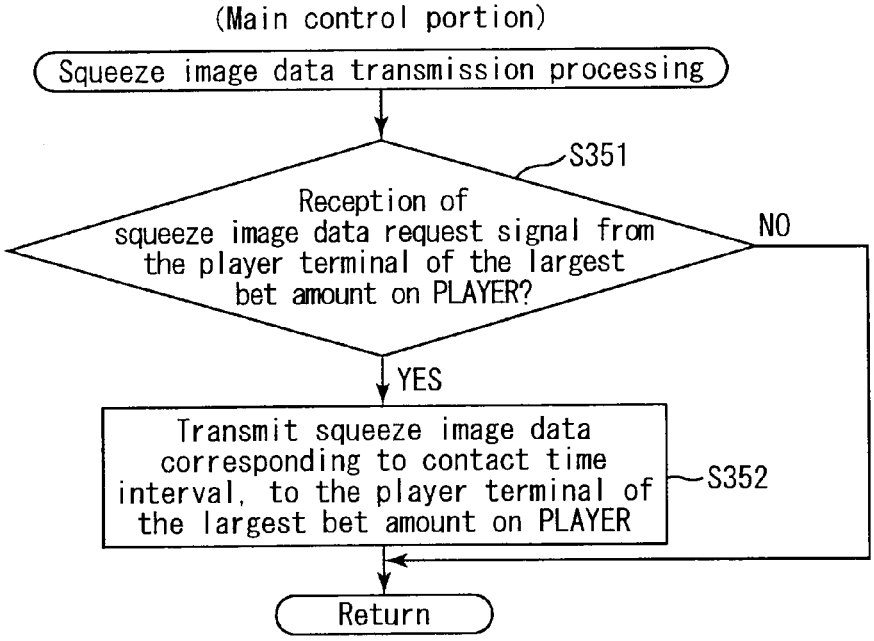
FIG. 16 is a flowchart illustrating a subroutine of squeeze image data transmission processing executed in a main control portion according to the second embodiment.

FIG. 16 is a flowchart illustrating a subroutine of the squeeze image data transmission processing executed in the main control portion.

First, the CPU 41 determines whether or not the CPU 41 has received a squeeze image data request signal from the player terminal 4 of the largest bet amount on "PLAYER" (step S351).

When the CPU 41 determines that the CPU 41 has received the squeeze image data request signal, the CPU 41 identifies squeeze image data.

In the second embodiment, the ROM 43 stores squeeze image data of fast squeeze-image display speed, squeeze image data of normal squeeze-image display speed, and squeeze image data of slow squeeze-image display speed, for each of the 52 playing cards.

The CPU 41 identifies squeeze image data according to the player card I or the player card II and to the contact time interval, from 156 squeeze image data stored in the ROM 43. The squeeze image data is identified based on the player card identification information, the contact time interval information, and the player card I information or the player card II information (see step S4 of FIG. 8) that are stored in the RAM 42.

The CPU 41 transmits the identified squeeze image data to the player terminal 4 that has transmitted the squeeze image data request signal (step S352).

When the CPU 41 determines in step S351 that the CPU 41 has not received the squeeze image data request signal, or after executing the processing of step S352, the CPU41 ends the present subroutine.

In the above, the squeeze image data transmission processing according to the second embodiment has been described with reference to FIG. 16.

Now, refer back to FIG. 15.

After executing the processing of step S311, the CPU 51 receives the squeeze image data from the main control portion 31 (step S312).

The CPU 51 then displays a moving image showing a scene that the card is turned over based on the received squeeze image data, instead of displaying the card face down, in the player card display area corresponding to the contact effective area identified in step S308 (step S313). At this time, the moving image of the card being turned over is displayed at a speed corresponding to the contact time interval.

The CPU 51 ends the present subroutine when determining in step S301 that the CPU 51 has not received the contact detection signal from the touch panel 11, when determining in step S302 that the largest bet flag is not set, when determining in step S303 that the contact position is not within either the contact effective area I or the contact effective area II, when determining in step S306 that the predetermined time has elapsed, or after executing the processing of step S313.

In the above, the second embodiment has been described with reference to FIG. 14 to FIG. 16.

According to the gaming machine 1 of the second embodiment and the control method thereof, a player can determine the speed for a card to be turned over by adjusting the time interval between the two successive contacts on the touch panel. That is, the speed of motion of the player's finger and the display speed of a squeeze image are linked at the time of displaying the squeeze image. Thereby, it is possible to provide to a player a feeling of actually turning over a card.

Although in the second embodiment the relationship between a contact time interval and a display speed of a squeeze image is a relationship as described in FIG. 14, the relationship between a contact time interval and a display speed of a squeeze image is not limited to this example. For example, a contact time interval and a display speed of a squeeze image may have a proportional relationship.

In the above, the embodiments (first embodiment and second embodiment) of the present invention have been described.

In the above embodiments, a squeeze image is displayed only on the liquid crystal display 10 of the player terminal 4 of the largest bet amount on "PLAYER". However, in the present invention, a squeeze image may also be displayed on the liquid crystal display provided to the other player terminals.

Figure 17:
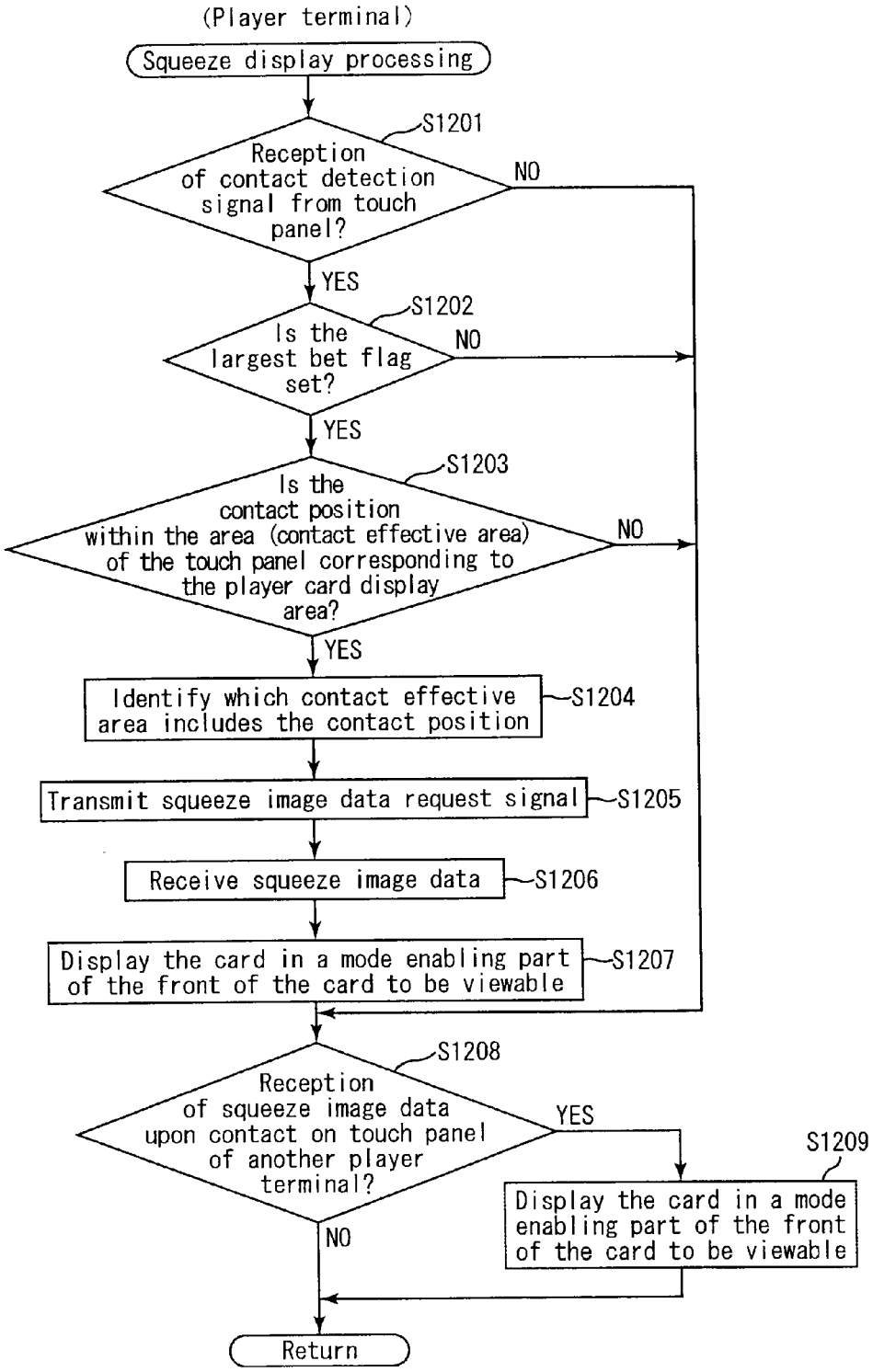
FIG. 17 is a flowchart illustrating a subroutine of squeeze display processing executed in each player terminal according to an other embodiment.

FIG. 17 is a flowchart illustrating a subroutine of a squeeze display processing executed in the player terminals according to an other embodiment.

Figure 18:
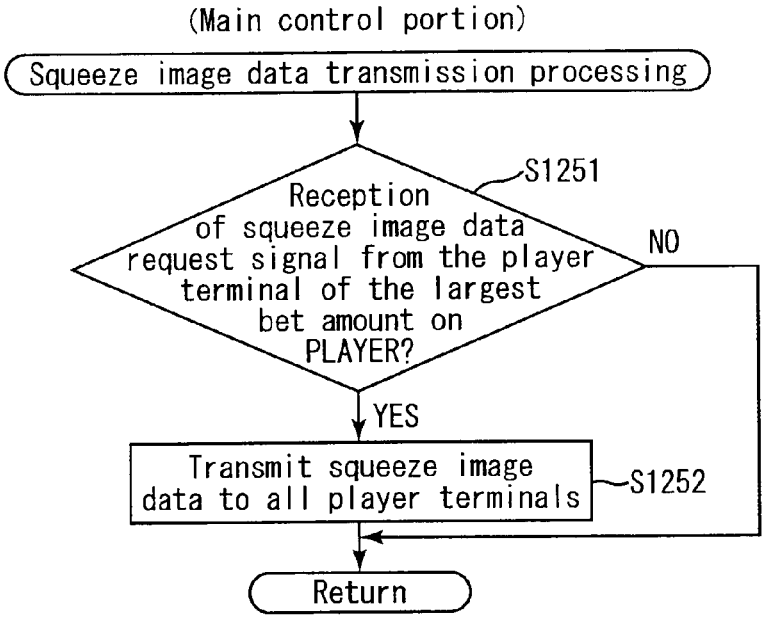
FIG. 18 is a flowchart illustrating a subroutine of squeeze image data transmission processing executed in a main control portion according to the other embodiment.

FIG. 18 is a flowchart illustrating a subroutine of a squeeze image data transmission processing executed in the main control portion according to the other embodiment.

In step S1252 of FIG. 18, the CPU 41 transmits identified squeeze image data to all the player terminals 4 (player terminal 4*a*, player terminal 4*b*, player terminal 4*c*, player terminal 4*d*, and player terminal 4*e*).

Meanwhile, the CPU 51 determines whether or not the CPU 51 has received the squeeze image data from the main control portion 31 upon contact (input of a squeeze command) on the touch panel 11 of another player terminal 4 (step S1208), when determining in step S1201 of FIG. 17 that the CPU 51 has not received a contact detection signal from the touch panel 11, when determining in step S1202 that the largest bet flag is not set, when determining in step S1203 that the contact position is not within either the contact effective area I or the contact effective area II, or after executing the processing of step S1207.

When the CPU 51 determines that the CPU 51 has received the squeeze image data, the CPU 51 displays a moving image showing a scene that one of the player card I and the player card II displayed face down is turned over, based on the received squeeze image data, instead of displaying the one of the cards face down (step S1209). The one of the cards is the card assigned with a number and a suit that are same as the number and the suit of the received squeeze image data.

When the CPU 51 determines in step S1208 that the CPU 51 has not received squeeze image data, or after executing the processing of step S1209, the CPU51 ends the present subroutine.

Since the other processing executed in the subroutine shown in FIG. 17 and FIG. 18 is the same as the processing in FIG. 10 and FIG. 11, descriptions are omitted here.

Although baccarat is executed in the gaming machine 1 in the above described embodiments, the game to be executed in a gaming machine according to the present invention is not limited to these examples. The game to be executed in a gaming machine according to the present invention is not limited so long as it is a game in which there is a chance for a player to turn over a card, and the game may be a game such as blackjack.

Further, the game executed in a gaming machine according to the present invention is not limited to a game in which normal playing cards are used, and the game may be a game using an item such as hanafuda.

In the above embodiments, the processing executed in the gaming machine 1 is conducted by the CPU 41 of the main control portion 31 together with the CPU 51 of each player terminal 4. The CPU 41 and the CPU 51 constitute the controller of the present invention. In this way, the controller of the present invention may have multiple CPUs, or may have one CPU.

Further, in the above embodiments, the ROM 53 stores the player card I display area address information and the player card II display area address information. The player card I display area address information and the player card II display area address information constitute the address information of the present invention, and the ROM 53 corresponds to the memory of the present invention.

The memory of the present invention is not limited to the above examples; for example, a memory to store address information may be provided in the main control portion instead of being provided in the player terminals.

In the above embodiments, a determination is made whether or not the contact position is within an area (contact effective area) of the touch panel 11 corresponding to the player card display area, based on the contact effective area address information. However, the processing relating to determination of whether or not the contact position is within the card display area is not limited to the above examples. For example, whether or not the contact position is within the contact effective area may be determined based on table data that is stored in the memory and that shows a table in which the card display area address information and the coordinate information, carried by the contact detection signal, are associated with each other.

In the above embodiments, a squeeze image is displayed based on the squeeze image data stored in advance. However, in the present invention, squeeze image data may be generated based on information (and contact time interval) showing a predetermined marking (for example, a number and a suit) assigned to the card of the squeeze target, when a squeeze command is inputted.

In the present invention, the dimension of the front of a card to be viewable may change according to the contact time interval.

In the present invention, the contact time from the start of contact on the touch panel to removal (contact end) may be measured, and the display speed of a squeeze image or the dimension of the front of a card to be viewable may change according to the measured contact time.

In the present invention, the moving distance of the contact position after the start of contact on the touch panel may be measured, and the display speed of a squeeze image or the dimension of the front of a card to be viewable may change according to the measured moving distance.

In the above embodiments, the two player cards (player card I and player card II) are displayed face down, and a command to turn over either one of the cards (squeeze command) is inputted. However, in the present invention, the number of cards to be displayed face down and to be the target of a squeeze command is not limited to two. The number of such cards may be three or more, or may be one.

Although the embodiments of the present invention were described above, they were just illustrations of specific examples, and hence do not particularly restrict the present invention. A specific configuration of each step and the like is appropriately changeable in terms of design. Further, the effects described in the embodiments of the present invention are just recitations of the most suitable effects generated from the present invention. The effects of the present invention are thus not limited to those described in the embodiments of the present invention.

Further, the foregoing detailed descriptions centered the characteristic parts of the present invention in order to facilitate understanding of the present invention. The present invention is not limited to the embodiments in the foregoing specific descriptions but applicable to other embodiments with a variety of application ranges. Further, terms and phrases in the present specification were used not for restricting interpretation of the present invention but for precisely describing the present invention. It is considered easy for the skilled in the art to conceive other configurations, systems, methods and the like included in the concept of the present invention from the concept of the invention described in the specification. Therefore, it should be considered that recitations of the claims include uniform configurations in a range not departing from the range of technical principles of the present invention. Moreover, an object of the abstract is to enable a patent office, a general public institution, an engineer belonging to the technical field who is unfamiliar with patent, technical jargon or legal jargon, and the like, to smoothly determine technical contents and an essence of the present application with simple investigation. Accordingly, the abstract is not intended to restrict the scope of the invention which should be evaluated by recitations of the claims. Furthermore, for thorough understanding of an object of the present invention and an effect specific to the present invention, it is desired to make interpretation in full consideration of documents already disclosed and the like.

The foregoing detailed descriptions include processing executed on a computer or a computer network. Explanations and expressions above are described with the aim of being most efficiently understood by the skilled person in the art. In the specification, each step for use in deriving one result should be understood as the self-consistent processing. Further, in each step, transmission/reception, recording or the like of an electrical or magnetic signal is performed. While such a signal is expressed by using a bit, a value, a symbol, a letter, a term, a number or the like in processing of each step, it should be noted that those are used simply for the sake of convenience in description. While there are cases where processing in each step may be described using an expression in common with that of action of a human, processing described in the specification is essentially executed by a variety of devices. Further, another configuration requested for performing each step should become apparent from the above descriptions.

What is claimed as new and desired to be secured by Letters Patent of the United States is:

1. A gaming machine comprising:

a display capable of displaying a playing card that has a predetermined identifying marking on at least one corner of the front and does not have the predetermined identifying marking on the back;

a touch panel provided on the front of the display; and a controller, the controller programmed to execute the processing of:

(A) displaying on the display a playing card in a display mode that displays the playing card face down; and (B) starting a display of a moving image in which the display mode of the playing card displayed in the processing (A) changes to a display mode enabling only a corner of the front of the playing card where the predetermined identifying marking appears to be viewable, upon successive contact twice on any position within an area of the playing card on the touch panel corresponding to an area of the display where the playing card is displayed, and displaying the moving image at a display speed in accordance with a time interval between a first contact and a second successive contact of the touch panel such that the greater the time interval between the first and second contacts, the slower the display speed of the moving image, the display speed of the moving image having no relation to a positional relationship between the first contact and the second successive contact of the touchpanel.

2. The gaming machine of claim 1, wherein the display is capable of displaying the playing card in a predetermined card display area;

the touch panel upon contact thereon, transmits a contact detection signal including coordinate information corresponding to the position of the contact; and wherein the gaming machine further comprises:

a memory storing address information corresponding to the predetermined card display area; and the controller is programmed to execute the processing of:

(A) displaying the playing card in the predetermined card display area face down, based on the address information stored in the memory;

(B) determining, upon reception of the contact detection signal from the touch panel, whether or not a position on the touch panel, corresponding to coordinate information carried by the received contact detection signal, is within an area of the touch panel corresponding to the predetermined card display area shown by the address information stored in the memory; and (C) changing the display mode of the playing card displayed in the predetermined card display area corresponding to an area of the touch panel which includes the position on the touch panel corresponding to the coordinate information carried by the received contact detection signal, to a display mode enabling a part of the front of the playing card to be viewable, when the controller determines in the processing (B) that the position on the touch panel is within the area of the touch panel corresponding to the predetermined card display area shown by the address information stored in the memory.

3. The gaming machine of claim 1, wherein the display comprises a plurality of card display areas, the memory stores pieces of address information each showing a card display area, for the respective card display areas, the processing (A) includes displaying multiple playing cards to the respective card display areas in a display mode that displays each playing card face down, based on the pieces of the address information stored in the memory, the processing (B) includes determining, upon reception of the contact detection signal from the touch panel, whether or not a position on the touch panel, corresponding to coordinate information carried by the received contact detection signal, is within an area of the touch panel corresponding to anyone of the multiple card display areas shown by the pieces of the address information stored in the memory, and the processing (C) includes changing the display mode of a playing card, displayed in one card display area corresponding to an area of the touch panel which includes the position on the touch panel corresponding to the coordinate information carried by the received contact detection signal, to a display mode enabling a part of the front of the playing card to be viewable, when the controller determines in the processing (B) that the position on the touch panel is within an area of the touch panel corresponding to anyone of the multiple card display areas shown by the pieces of the address information stored in the memory.

4. The gaming machine of claim 1, wherein an entirety of the front of the playing card is displayed after a predetermined time has elapsed after display of the moving image.

5. A control method of a gaming machine, wherein the gaming machine comprises:

a display capable of displaying a playing card that has a predetermined identifying marking on at least a corner of the front and does not have the predetermined identifying marking on the back;

a touch panel provided on the front of the display; and a controller, the control method comprising the steps of:

(A) the controller displaying on the display at least one playing card in a display mode that displays each playing card face down; and (B) the controller starting a display of a moving image in which the display mode of one of the at least one playing card displayed in the step (A) changes to a display mode enabling only a corner of the front of the playing card where the predetermined identifying marking appears to be viewable, upon successive contact twice on any position within an area of the playing card on the touch panel corresponding to an area of the display where the one of the at least one playing card is displayed, and displaying the moving image at a display speed in accordance with a time interval between a first contact and a second successive contact of the touch panel such that the greater the time interval between the first and second contacts, the slower the display speed of the moving image, the display speed of the moving image having no relation to a positional relationship between the first contact and the second successive contact of the touch-panel.

6. A gaming machine comprising:

a display capable of displaying a playing card that has a predetermined identifying marking on at least a corner of the front and does not have the predetermined identifying marking on the back;

a touch panel provided on the front of the display;

moving image display means for starting a display of a moving image in which a display mode of one of at least one playing card displayed face down changes to a display mode enabling only a corner of the front of the playing card where the predetermined identifying marking appears to be viewable, upon successive contact twice on any position within an area of the playing card on the touch panel corresponding to an area of the display where the one of the at least one playing card is displayed; and displaying the moving image at a display speed in accordance with a time interval between a first contact and a second successive contact of the touch panel such that the greater the time interval between the first and second contacts, the slower the display speed of the moving image, the display speed of the moving image having no relation to a positional relationship between the first contact and the second successive contact of the touch-panel.

* * * * *